US011840981B2

(12) United States Patent
Terakado et al.

(10) Patent No.: US 11,840,981 B2
(45) Date of Patent: Dec. 12, 2023

(54) THERMAL BARRIER COATING MEMBER

(71) Applicant: MITSUBISHI HEAVY INDUSTRIES ENGINE & TURBOCHARGER, LTD., Sagamihara (JP)

(72) Inventors: Kiyoshi Terakado, Tokyo (JP); Yuji Bessho, Sagamihara (JP); Kimihiko Maehata, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 2 days.

(21) Appl. No.: 17/791,032

(22) PCT Filed: Jun. 25, 2020

(86) PCT No.: PCT/JP2020/024978
§ 371 (c)(1),
(2) Date: Jul. 6, 2022

(87) PCT Pub. No.: WO2021/166278
PCT Pub. Date: Aug. 26, 2021

(65) Prior Publication Data

US 2023/0026354 A1 Jan. 26, 2023

(30) Foreign Application Priority Data

Feb. 18, 2020 (JP) ..... 2020-025270

(51) Int. Cl.
*F02F 1/00* (2006.01)

(52) U.S. Cl.
CPC ..... *F02F 1/004* (2013.01)

(58) Field of Classification Search
CPC ..... F02F 1/00; F02F 1/004; F02F 2001/008
See application file for complete search history.

(56) References Cited

U.S. PATENT DOCUMENTS 5,189,992 A 3/1993 Hama et al.
6,367,463 B1 4/2002 Nurmi
(Continued)

FOREIGN PATENT DOCUMENTS

DE 10 2018 205 673 A1 10/2018
EP 3 075 997 A1 10/2016
(Continued)

OTHER PUBLICATIONS

International Preliminary Report on Patentability and Written Opinion of the International Searching Authority for International Application No. PCT/JP2020/024978, dated Sep. 1, 2022, with an English translation.

(Continued)

*Primary Examiner* — Grant Moubry
(74) *Attorney, Agent, or Firm* — Birch, Stewart, Kolasch & Birch, LLP

(57) ABSTRACT

At least one thermal barrier coating member mounted on an inner wall surface, facing a combustion chamber of an engine, of a cylinder liner accommodating a piston slidably along an axial direction, is provided with: a base layer configured to be detachably fitted into a recess formed in the inner wall surface of the cylinder liner; and a thermal barrier coating layer formed on an opposite side of the base layer from the inner wall surface of the cylinder liner. The thermal barrier coating layer is disposed above a piston ring which is positioned at an uppermost position in the axial direction of the cylinder liner when the piston reaches top dead center.

9 Claims, 12 Drawing Sheets

(56) References Cited

U.S. PATENT DOCUMENTS

| | | | | |
|---|---|---|---|---|
| 2016/0356239 | A1* | 12/2016 | Graham | F02F 1/16 |
| 2017/0002734 | A1* | 1/2017 | Watanabe | F02B 77/04 |
| 2020/0166001 | A1* | 5/2020 | Jenness | C23C 28/3455 |

FOREIGN PATENT DOCUMENTS

| | | | |
|---|---|---|---|
| GB | 2 009 884 | A | 6/1979 |
| JP | 4-134648 | U | 12/1992 |
| JP | 8-42389 | A | 2/1996 |
| JP | 2007-32401 | A | 2/2007 |
| JP | 2014-80903 | A | 5/2014 |
| JP | 2014-88863 | A | 5/2014 |
| JP | 2014-208981 | A | 11/2014 |
| JP | 2016-75270 | A | 5/2016 |
| JP | 2016-84713 | A | 5/2016 |
| JP | 2017-67012 | A | 4/2017 |
| JP | 2017-155639 | A | 9/2017 |
| JP | 2018-21537 | A | 2/2018 |
| WO | WO 2007/048439 | A1 | 5/2007 |
| WO | WO 2015/134162 | A1 | 9/2015 |

OTHER PUBLICATIONS

International Search Report and Written Opinion of the International Searching Authority for International Application No. PCT/JP2020/024978, dated Aug. 25, 2020.

Extended European Search Report for European Application No. 20919511.4, dated Jan. 9, 2023.

* cited by examiner

THERMAL BARRIER COATING MEMBER

TECHNICAL FIELD

The present disclosure relates to a thermal barrier coating member mounted on a cylinder liner accommodating a piston slidably along the axial direction.

BACKGROUND

In order to achieve a low fuel consumption rate for an engine, it is important to reduce the amount of heat loss in a combustion chamber of the engine. It is known that forming a thermal barrier coating on the inner wall surface of a cylinder liner which defines the combustion chamber of the engine suppresses the release of heat generated by the combustion of air-fuel mixture to the outside of the combustion chamber through the inner wall surface and thus reduces the heat loss in the combustion chamber (for example, Patent Document 1). The cylinder liner described in Patent Document 1 has a first thermal barrier coating formed on the inner wall surface at a portion (a portion mainly constituting the combustion chamber) on the upper side in the cylinder axis direction, and a second thermal barrier coating formed on the inner wall surface at a portion on the lower side in the cylinder axis direction. Each of the first thermal barrier coating and the second thermal barrier coating is formed over the entire circumference on the inner wall surface of the cylinder liner. Further, the second thermal barrier coating has a thermal conductivity smaller than that of the first thermal barrier coating.

CITATION LIST

Patent Literature

Patent Document 1: JP2018-21537A

SUMMARY

Problems to be Solved

If the engine is operated for a long time, the thermal barrier coating may be damaged or worn. For example, in the cylinder liner described in Patent Document 1, as the piston moves vertically along the cylinder axis direction in the cylinder liner, the piston ring mounted on the piston comes into slide contact with the thermal barrier coating, so that the thermal barrier coating may be peeled off from the cylinder liner, or the surface of the thermal barrier coating may be eroded to reduce the thickness of the thermal barrier coating. In addition, the surface of the thermal barrier coating may be eroded due to erosion during engine operation to reduce the thickness of the thermal barrier coating.

Further, if the engine is operated for a long time, deposits such as carbon (soot) generated by the combustion of air-fuel mixture may adhere to the wall surface of the combustion chamber and reduce the fuel efficiency of the engine. In order to avoid the reduction in the fuel efficiency of the engine, maintenance work may be performed to scrape off the deposits from the wall surface of the combustion chamber with a metal brush, for example, but the thermal barrier coating may be damaged during the maintenance work. Therefore, in order to maintain the thermal barrier performance of the thermal barrier coating, it is necessary to replace parts such as the cylinder liner on which the thermal barrier coating is formed. Since the entire part on which the thermal barrier coating is formed, such as the cylinder liner, is replaced, the cost for maintaining the thermal barrier performance of the thermal barrier layer may increase.

In view of the above circumstances, an object of at least one embodiment of the present disclosure is to provide a thermal barrier coating member that can suppress damage to the thermal barrier coating and suppress an increase in the cost for maintaining the thermal barrier performance of the thermal barrier layer.

Solution to the Problems

A thermal barrier coating member according to the present disclosure is at least one thermal barrier coating member mounted on an inner wall surface, facing a combustion chamber of an engine, of a cylinder liner accommodating a piston slidably along the axial direction. The thermal barrier coating member is provided with: a base layer configured to be detachably fitted into a recess formed in the inner wall surface of the cylinder liner; and a thermal barrier coating layer formed on the opposite side of the base layer from the inner wall surface of the cylinder liner. The thermal barrier coating layer is disposed above a piston ring which is positioned at the uppermost position in the axial direction of the cylinder liner when the piston reaches top dead center.

Advantageous Effects

At least one embodiment of the present disclosure provides a thermal barrier coating member that can suppress damage to the thermal barrier coating and suppress an increase in the cost for maintaining the thermal barrier performance of the thermal barrier layer.

DETAILED DESCRIPTION

Figure 1:
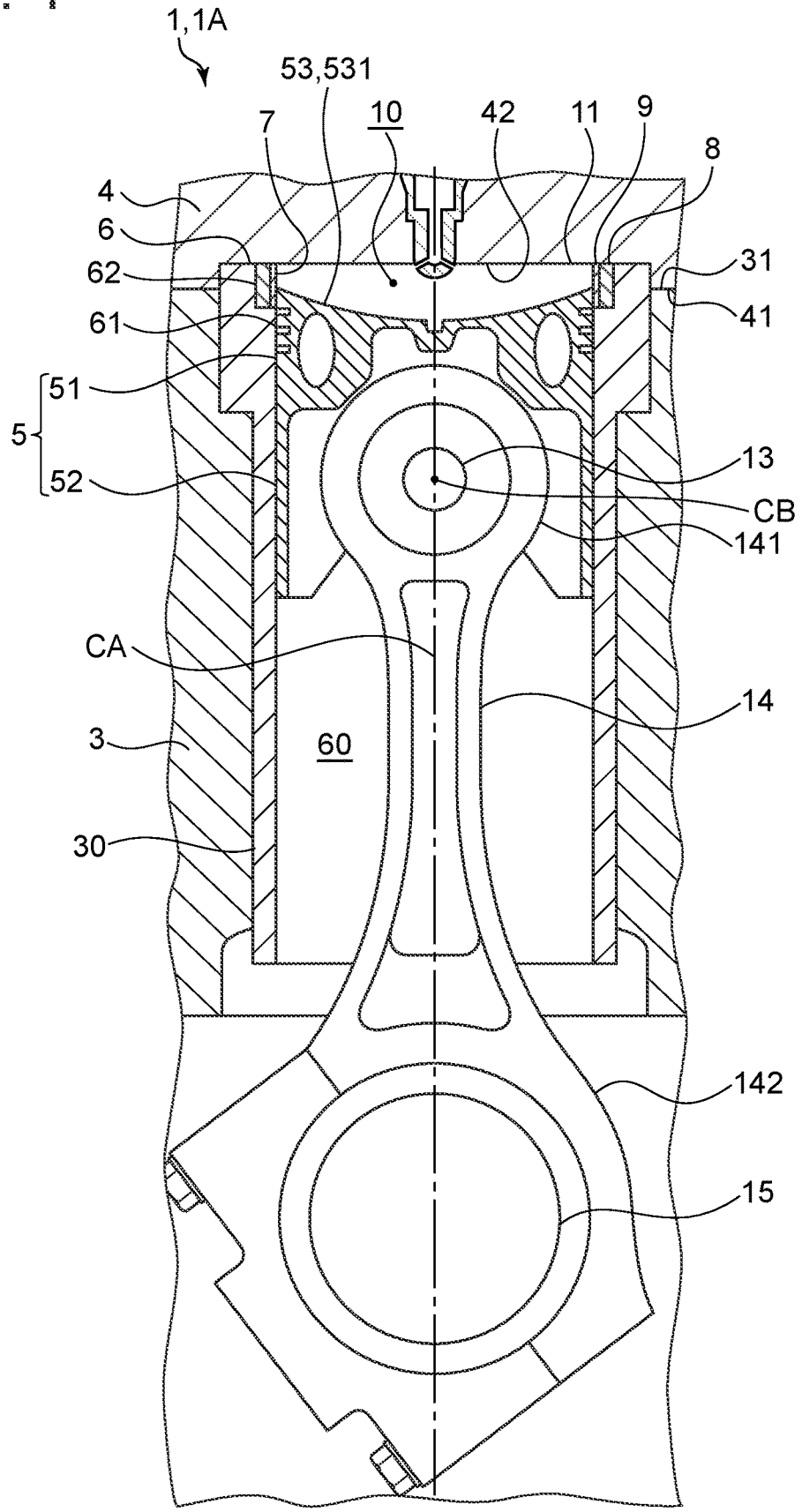
FIG. 1 is a schematic cross-sectional view of an engine having a combustion chamber according to an embodiment of the present disclosure.

Embodiments of the present disclosure will be described below with reference to the accompanying drawings. It is intended, however, that unless particularly identified, dimensions, materials, shapes, relative positions, and the like of components described in the embodiments shall be interpreted as illustrative only and not intended to limit the scope of the present disclosure.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

The same features can be indicated by the same reference numerals and not described in detail.

(Engine)

Figure 2:
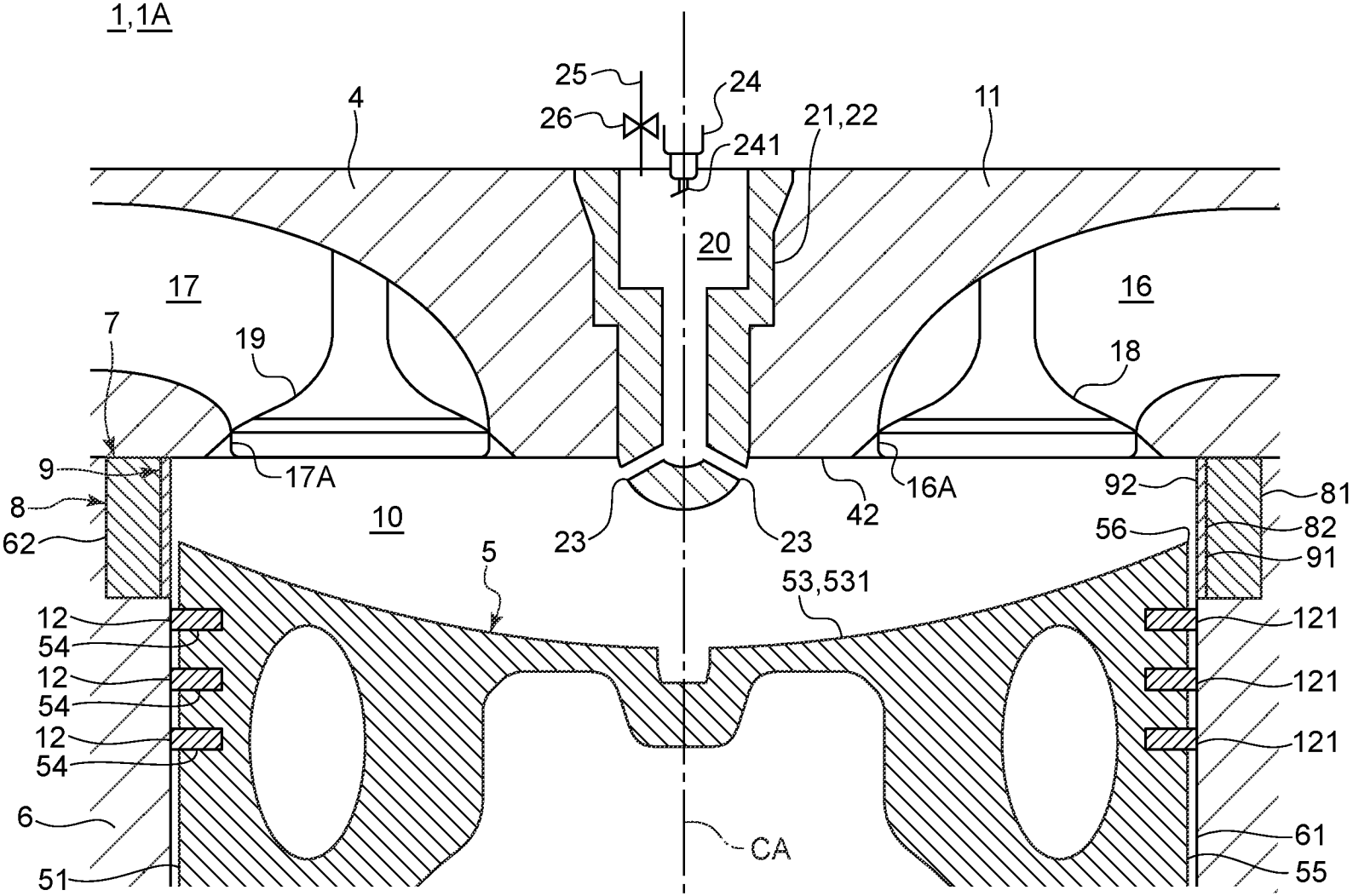
FIG. 2 is a schematic enlarged cross-sectional view of the vicinity of the combustion chamber of the engine shown in FIG. 1.

FIG. 1 is a schematic cross-sectional view of an engine having a combustion chamber according to an embodiment of the present disclosure. FIG. 2 is a schematic enlarged cross-sectional view of the vicinity of the combustion chamber of the engine shown in FIG. 1. As shown in FIGS. 1 and 2, a thermal barrier coating member 7 according to some embodiments is mounted on an inner wall surface 61 of a cylinder liner 6 facing a combustion chamber 10 of an engine 1. First, the combustion chamber 10 of the engine 1 will be described.

As shown in FIG. 1, the engine 1 includes a cylinder block 3, a cylinder head 4, a piston 5, and a cylinder liner 6. Hereinafter, the extension direction of the center axis CA of the cylinder liner 6 (vertical direction in FIG. 1) is defined as the axial direction. In the axial direction, the side where the cylinder head 4 is located with respect to the piston 5 (upper side in FIG. 1) is defined as the upper side, and the side opposite to the upper side is defined as the lower side. Further, the direction perpendicular to the axial direction of the cylinder liner 6 is defined as the radial direction. In the radial direction, the side toward the center axis CA of the cylinder liner 6 is defined as the inner side or inside, and the side away from the center axis CA is defined as the outer side or outside.

The cylinder block 3 has a cylindrical space 30 extending along the axial direction. In the cylindrical space 30, the cylinder liner 6 of cylindrical shape extending along the axial direction is fitted from above in the axial direction. The cylinder liner 6 is configured to accommodate the piston 5 slidably along the axial direction.

The piston 5 is accommodated in an interior space 60 defined by an inner wall surface 61 of the cylinder liner 6. The piston 5 is formed in a bottomed tubular shape including ahead portion 51 having a circular contour shape when viewed from above in the axial direction and a cylindrical skirt portion 52 extending downward along the axial direction from a lower outer peripheral edge of the head portion 51 in the axial direction. The piston 5 has a top surface 53 disposed at the upper side of the head portion 51 in the axial direction. In the embodiment shown in FIG. 1, the top surface 53 has a concave curved surface 531 recessed downward in the axial direction toward the inside in the radial direction.

The piston 5 is mechanically connected to one end portion 141 of a connecting rod 14 via a piston pin 13. The connecting rod 14 includes the above-described one end portion 141 and the other end portion 142 disposed on the opposite side from the one end portion 141. The other end portion 142 of the connecting rod 14 is mechanically connected to a crankshaft 15.

The cylinder head 4 is attached to the cylinder block 3 so that a lower end portion 41 disposed on the lower side in the axial direction abuts on an upper end portion 31 of the cylinder block 3 disposed on the upper side in the axial direction. A gasket (not shown) may be interposed between the upper end portion 31 and the lower end portion 41.

As shown in FIG. 2, when the piston 5 is at top dead center, the combustion chamber 10 is defined between the piston 5 and the cylinder head 4 in the axial direction. The combustion chamber 10 is defined by the top surface 53 of the piston 5, a lower surface 42 of the cylinder head 4 disposed opposite to the top surface 53 of the piston 5, and the inner wall surface 61 of the cylinder liner 6.

At least one annular piston ring groove 54 to which a piston ring 12 is mounted is formed on the outer peripheral portion of the head portion 51 of the piston 5. In the embodiment shown in FIG. 2, three annular piston ring grooves 54 are formed on the outer peripheral portion of the head portion 51 at separate positions in the axial direction. The piston ring 12 mounted in the piston ring groove 54 has an outer peripheral surface 121 which protrudes outward in the radial direction from the outer peripheral surface 55 of the head portion 51 and abuts on the inner wall surface 61 of the cylinder liner 6. The outer peripheral surface 121 slides on the inner wall surface 61 of the cylinder liner 6 when the piston 5 slides in the cylinder liner 6 along the axial direction. The gap between the inner wall surface 61 of the cylinder liner 6 and the outer peripheral surface 55 of the piston 5 is closed by the piston ring 12.

As shown in FIG. 2, inside the cylinder head 4, an intake passage 16 for supplying combustion gas to the combustion chamber 10 and an exhaust passage 17 for discharging exhaust gas from the combustion chamber 10 are formed. The intake passage 16 allows gas (combustion gas) to flow to the combustion chamber 10 through an intake port 16A formed in the lower surface 42 of the cylinder head 4. The exhaust passage 17 allows gas (exhaust gas) to flow from the combustion chamber 10 through an exhaust port 17A formed in the lower surface 42 of the cylinder head 4.

As shown in FIG. 2, the engine 1 includes an intake valve 18 configured to open and close the intake port 16A, and an exhaust valve 19 configured to open and close the exhaust port 17A. When the intake port 16A is fully closed by the intake valve 18, the supply of intake air from the intake passage 16 to the combustion chamber 10 is cut off. Further, when the exhaust port 17A is fully closed by the exhaust valve 19, the discharge of exhaust gas from the combustion chamber 10 to the exhaust passage 17 is cut off.

As shown in FIG. 2, the engine 1 includes an ignition device 24. In the embodiment shown in FIG. 2, the ignition device 24 is composed of an ignition plug 241 capable of igniting air-fuel mixture. Further, in the embodiment shown in FIG. 2, the engine 1 is composed of a precombustion chamber engine 1A including a combustion chamber forming portion 11 which forms the combustion chamber 10 and a precombustion chamber forming portion 21 which forms a precombustion chamber 20. In the engine 1A, the ignition device 24 is disposed in the precombustion chamber 20. The combustion chamber forming portion 11 includes the cylinder head 4, the piston 5, and the cylinder liner 6, which are members defining the combustion chamber 10. In this disclosure, the precombustion chamber engine 1A will be described as an example, but the thermal barrier coating member 7 according to some embodiments of the present disclosure can also be applied to an engine of a direct injection type in which the ignition device 24 is provided in the combustion chamber 10. The thermal barrier coating member 7 according to some embodiments of the present disclosure can be applied to any of a diesel engine, a gas engine, and a gasoline engine.

In the embodiment shown in FIG. 2, the precombustion chamber forming portion 21 includes a precombustion chamber mouthpiece 22 disposed on the cylinder head 4 so as to be positioned above the combustion chamber 10 (opposite to the piston 5 in the axial direction). The precombustion chamber 20 is formed in the precombustion chamber mouthpiece 22. The precombustion chamber forming portion 21 has a plurality of injection holes 23 connecting the precombustion chamber 20 formed therein to the outside. The combustion chamber 10 communicates with the precombustion chamber 20 via the plurality of injection holes 23.

In the embodiment shown in FIG. 2, the engine 1 includes a fuel supply device 25 for directly supplying a fuel gas to the precombustion chamber 20 not via the combustion chamber 10. As shown in FIG. 2, the fuel supply device 25 is configured to supply a fuel gas to the precombustion chamber 20, and the supply amount of the fuel gas to the precombustion chamber 20 is controlled by the opening degree of a fuel supply valve 26.

In the engine 1 (1A), when the piston 5 moves downward in the intake stroke, the intake valve 18 opens the intake port 16A, and the exhaust valve 19 closes the exhaust port 17A. When the intake port 16A is opened, a lean premixed gas mixing the fuel gas and air is introduced into the combustion chamber 10 through the intake passage 16. Further, as the fuel supply valve 26 opens, the fuel gas is introduced into the precombustion chamber 20. Meanwhile, in the compression stroke, when the piston 5 moves upward, the fuel supply valve 26 closes. Further, the lean premixed gas introduced into the combustion chamber 10 through the intake port 16A is compressed as the piston 5 moves upward, and a part of the lean premixed gas is introduced into the precombustion chamber 20 through each of the injection holes 23 of the precombustion chamber 20.

In the combustion stroke, the lean premixed gas introduced from the combustion chamber 10 to the precombustion chamber 20 is mixed with the fuel gas to produce an air-fuel mixture having a concentration suitable for ignition in the precombustion chamber 20. The air-fuel mixture in the precombustion chamber 20 is ignited by the ignition device 24 at a predetermined timing when the piston 5 arrives at the vicinity of the compression top dead center, which leads to combustion of the air-fuel mixture in the precombustion chamber 20. The combustion flame generated by the combustion in the precombustion chamber 20 is injected into the combustion chamber 10 through each of the injection holes 23, and ignites the lean premixed gas in the combustion chamber 10. This leads to combustion of the lean premixed gas in the combustion chamber 10. The piston 5 which receives the combustion pressure of the lean premixed gas in the combustion chamber 10 reciprocates (moves vertically) in the cylinder liner 6 along the axial direction. The reciprocating motion of the piston 5 is converted to a rotational motion by the connecting rod 14 and the crankshaft 15.

Figure 3:
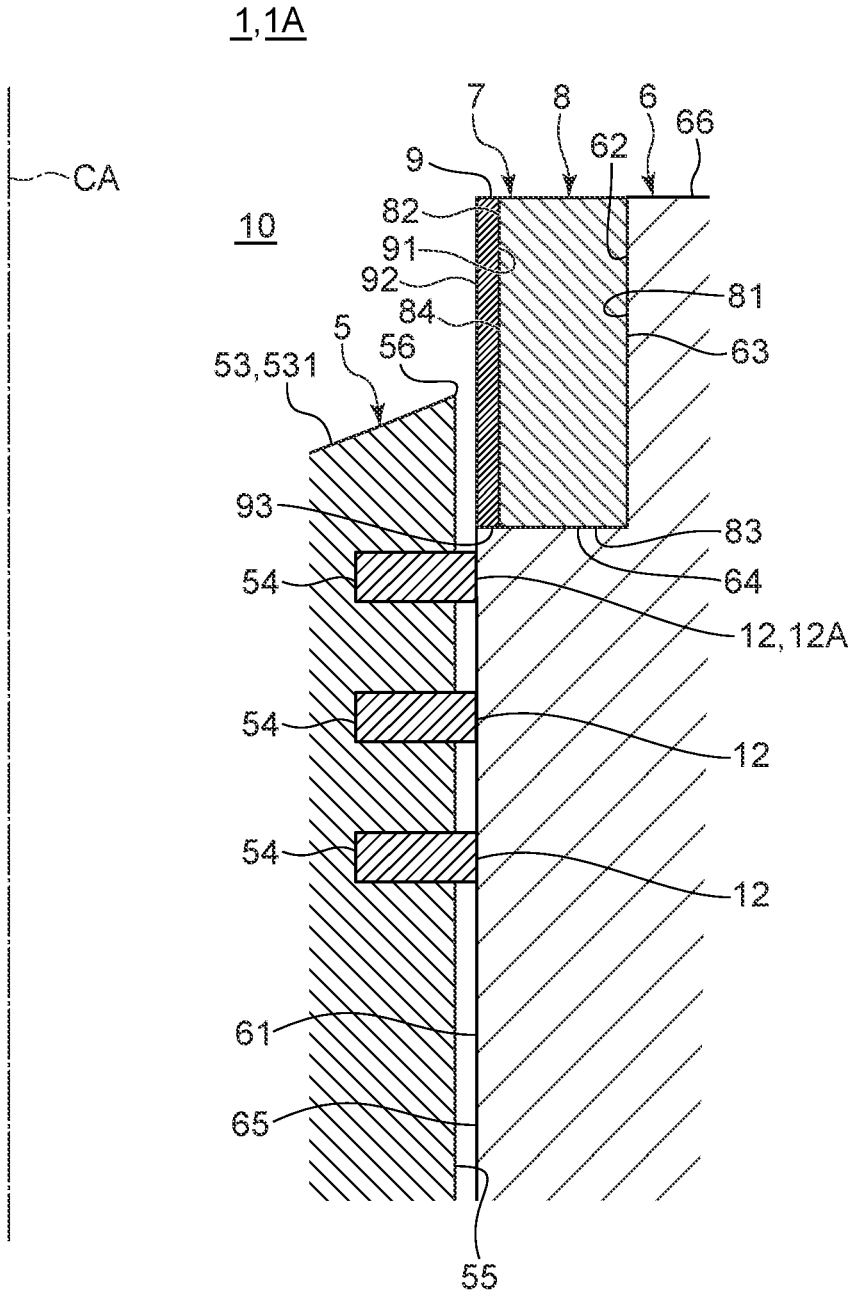
FIG. 3 is an explanatory diagram for describing the thermal barrier coating member according to an embodiment of the present disclosure and schematically shows a cross-section along the center axis of the cylinder liner.
Figure 4:
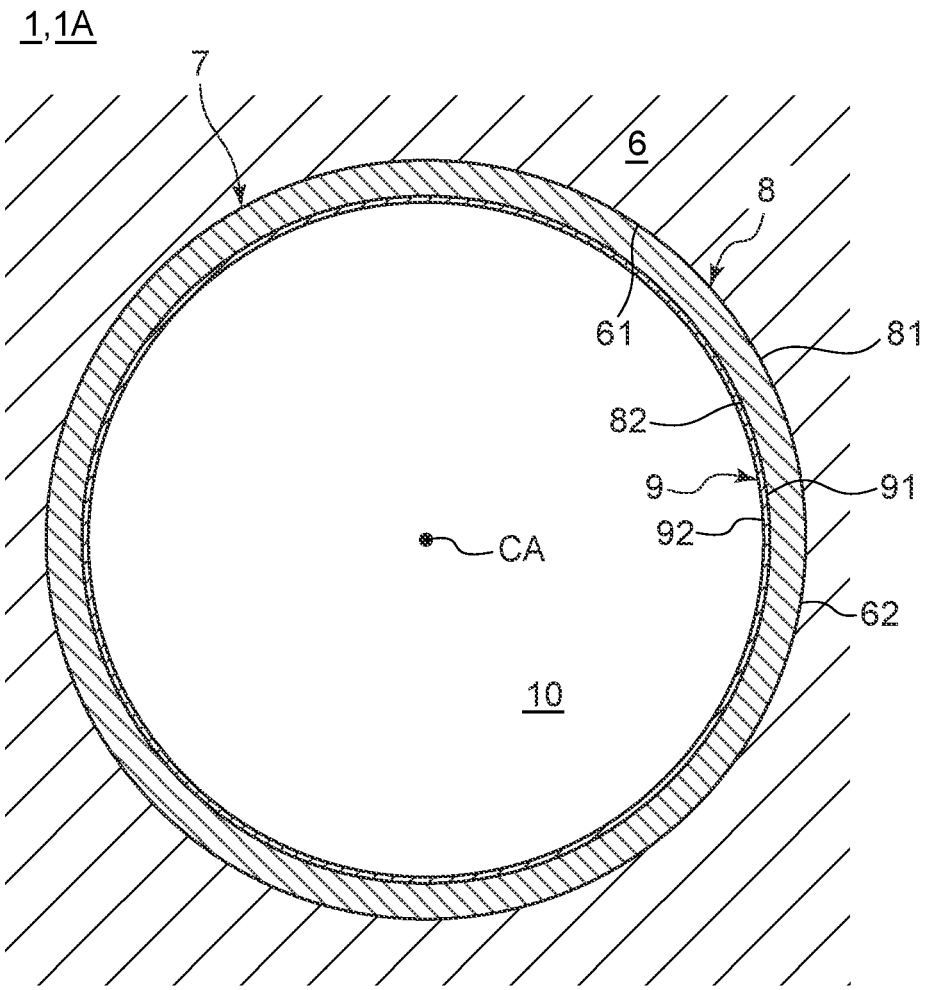
FIG. 4 is an explanatory diagram for describing the thermal barrier coating member according to an embodiment of the present disclosure and schematically shows a plan view when the combustion chamber is viewed from below in the axial direction.

FIG. 3 is an explanatory diagram for describing the thermal barrier coating member according to an embodiment of the present disclosure and schematically shows a cross-section along the center axis of the cylinder liner. FIG. 4 is an explanatory diagram for describing the thermal barrier coating member according to an embodiment of the present disclosure and schematically shows a plan view when the combustion chamber is viewed from below in the axial direction.

As shown in FIG. 2, for example, the thermal barrier coating member 7 according to some embodiments includes a base layer 8 configured to be detachably fitted into a recess 62 formed in the inner wall surface 61 of the cylinder liner 6, and a thermal barrier coating layer 9 formed on the opposite side (inside surface) 82 of the base layer 8 from the inner wall surface 61 of the cylinder liner 6. As shown in FIG. 2, the thermal barrier coating layer 9 is disposed above the piston ring 12 (combustion chamber-side piston ring 12A) which is at the uppermost position of the cylinder liner 6 in the axial direction when the piston 5 reaches top dead center.

In the illustrated embodiment, as shown in FIG. 3, the inner wall surface 61 of the cylinder liner 6 includes an inner wall surface 65 which extends along the axial direction and comes into contact with the outer peripheral surface 121 of the piston ring 12, and a step wall surface 63 which is disposed above and radially outward of the inner wall surface 65 and extends along the axial direction. The upper end of the step wall surface 63 is connected to an upper surface 66 of the cylinder liner 6. Further, a step surface 64 is formed between the lower end of the step wall surface 63 and the upper end of the inner wall surface 65 to connect them. The step surface 64 extends along a direction intersecting (e.g., perpendicular to) the axial direction. The recess 62 includes the step wall surface 63 and the step surface 64. In the embodiment shown in FIG. 4, the recess 62 (step wall surface 63 and step surface 64) is formed in an annular shape extending along the circumferential direction of the cylinder liner 6.

In the illustrated embodiment, as shown in FIG. 3, the base layer 8 is formed in a cylindrical shape extending along the axial direction. The base layer 8 has an outside surface 81 disposed on the outer side in the radial direction, and an inside surface 82 disposed on the opposite side from the outside surface 81, that is, on the inner side in the radial direction. The thermal barrier coating layer 9 has one surface 91 formed on the inside surface 82 of the base layer 8, and the other surface 92 disposed on the opposite side from the one surface 91 and facing the combustion chamber 10. In the embodiment shown in FIG. 3, the thermal barrier coating layer 9 is formed on the inside surface 82 from the upper end to the lower end of the inside surface 82. When the thermal barrier coating member 7 is attached to the recess 62 of the cylinder liner 6, the outside surface 81 of the base layer 8 faces the step wall surface 63, and a lower end portion 83 of the base layer 8 abuts on the step surface 64. The step surface 64 and the lower end portion 83 of the base layer 8 are positioned below the upper end 56 of the piston 5 when the piston 5 reaches top dead center. Further, as shown in FIG. 4, the thermal barrier coating layer 9 is formed on the inside surface 82 over the entire circumference of the cylinder liner 6 in the circumferential direction.

The thermal barrier coating layer 9 is configured to have a lower thermal conductivity than the base layer 8 and the cylinder liner 6. For example, the thermal barrier coating layer 9 may be formed by supporting a ceramic made of zirconia, titanium oxide, or aluminum oxide on the inside surface 82 of the base layer 8 by surface treatment such as thermal spraying, plating, or vacuum vapor deposition. Further, the thermal barrier coating layer 9 may be an anodic oxide film formed on the inside surface 82 of the base layer 8 by anodic oxidation. Further, it may be formed by applying a thermal barrier coating or a heat insulation coating to the inside surface 82 of the base layer 8. The thermal barrier coating layer 9 is desirably configured to have a high conformability to the temperature of the gas in the combustion chamber 10. For example, when the thermal barrier coating layer 9 has a small heat capacity and a high conformability, the temperature difference between the thermal barrier coating layer 9 and the gas in the combustion chamber 10 can be reduced, so that the heat loss can be reduced.

The base layer 8 is configured to have a thermal conductivity equivalent to or lower than the cylinder liner 6. In the illustrated embodiment, the base layer 8 is made of aluminum of the same type as the cylinder liner 6. The base layer 8 and the cylinder liner 6 may be made of steel, titanium, nickel, copper, or an alloy thereof instead of aluminum. The base layer 8 may be made of a different material from the cylinder liner 6. For example, in an embodiment, the base layer 8 has a smaller linear expansion coefficient than the cylinder liner 6 and a higher linear expansion coefficient than the thermal barrier coating layer 9. In this case, since the difference in the linear expansion coefficient between the base layer 8 and the thermal barrier coating layer 9 is small, when the base layer 8 and the thermal barrier coating layer 9 expand due to heat transferred from the combustion chamber 10, it is possible to prevent the thermal barrier coating layer 9 from separating from the base layer 8.

The replacement of the thermal barrier coating member 7 will be described with reference to FIG. 1. First, the cylinder head 4 is detached from the cylinder block 3. Then, the thermal barrier coating member 7 is pulled out upward in the axial direction, removed from the cylinder liner 6, and replaced with a new thermal barrier coating member 7. After the thermal barrier coating member 7 is replaced, the cylinder head 4 is attached to the cylinder block 3. The replacement of the thermal barrier coating member 7 can be performed more easily and quickly than the replacement of the cylinder liner 6 on which the thermal barrier coating is directly formed.

In the illustrated embodiment, as shown in FIG. 3, each of the step surface 64 of the recess 62 and the lower end portion 83 of the base layer 8 is disposed above a combustion chamber-side piston ring 12A when the piston 5 reaches top dead center. In this case, since the thermal barrier coating member 7 can be removed from the cylinder liner 6 regardless of the position of the piston 5 incorporated in the engine 1, the thermal barrier coating member 7 can be easily replaced. Further, when each of the step surface 64 of the recess 62 and the lower end portion 83 of the base layer 8 is disposed above the combustion chamber-side piston ring 12A when the piston 5 reaches top dead center, it is unnecessary to smoothly connect the cylinder liner 6 and the thermal barrier coating member 7. Thus, strict dimensional control is not required for the thermal barrier coating member 7. However, in some embodiments, each of the step surface 64 of the recess 62 and the lower end portion 83 of the base layer 8 may be disposed below the combustion chamber-side piston ring 12A when the piston 5 reaches top dead center.

If the thermal barrier coating is directly formed on the cylinder liner 6, when the piston 5 is assembled from above the cylinder liner 6 at the time of manufacturing or replacement of parts, the thermal barrier coating of the cylinder liner 6 may be damaged due to the piston 5. Assembling the piston 5 from below the cylinder liner 6 in order to avoid damage to the thermal barrier coating of the cylinder liner 6 requires the assembling of the cylinder liner 6 incorporated with the piston 5 to the engine 1, which takes a lot of effort. In contrast, when the thermal barrier coating layer 9 is provided on the thermal barrier coating member 7 that is detachable from the cylinder liner 6, it is easy to assemble the piston 5. Specifically, by removing the thermal barrier coating member 7 from the cylinder liner 6 when the piston 5 is assembled to the engine 1, the piston 5 can be assembled from above the cylinder liner 6 without damaging the thermal barrier coating layer 9. After the piston 5 is assembled to the engine 1, by attaching the thermal barrier coating member 7 to the cylinder liner 6, damage to the thermal barrier coating layer 9 can be reduced.

As described above, for example as shown in FIG. 2, the thermal barrier coating member 7 according to some embodiments includes the base layer 8 configured to be detachably fitted into the recess 62 formed in the inner wall surface 61 of the cylinder liner 6, and the thermal barrier coating layer 9 formed on the opposite side (inside surface) 82 of the base layer 8 from the inner wall surface 61 of the cylinder liner 6. As shown in FIG. 2, the thermal barrier coating layer 9 is disposed above the combustion chamber-side piston ring 12A when the piston 5 reaches top dead center.

According to the above configuration, the thermal barrier coating member 7 includes the base layer 8 and the thermal barrier coating layer 9 formed on the opposite side (inside surface) 82 of the base layer 8 from the inner wall surface 61 of the cylinder liner 6. Further, the base layer 8 of the thermal barrier coating member 7 is configured to be detachably fitted into the recess 62 of the cylinder liner 6. Accordingly, by replacing the thermal barrier coating member 7, the thermal barrier coating layer 9 can be replaced without replacing the cylinder liner 6. In contrast, when the thermal barrier coating layer 9 is directly formed on the cylinder liner 6, the cylinder liner 6 needs to be replaced in order to replace the thermal barrier coating layer 9. Thus, with the above-described thermal barrier coating member 7, since the thermal barrier coating layer 9 can be replaced without replacing the cylinder liner 6, as compared to the case where the thermal barrier coating layer 9 is directly formed on the cylinder liner 6, it is possible to suppress an increase in the cost for maintaining the thermal barrier performance of the thermal barrier coating layer 9.

Specifically, according to the above configuration, the replacement of the thermal barrier coating member 7 can be performed easily and quickly. Further, since deposits adhering to the thermal barrier coating layer 9 can be removed with the thermal barrier coating member 7 detached from the cylinder liner 6, as compared to the case where the thermal barrier coating layer 9 is directly formed on the cylinder liner 6, the maintenance of the thermal barrier coating layer 9 can be performed easily and quickly. Thus, with the above-described thermal barrier coating member 7, since the replacement and maintenance of the thermal barrier coating layer 9 can be performed easily and quickly, it is possible to suppress an increase in the cost for maintaining the thermal barrier performance of the thermal barrier coating layer 9. Further, if a high-performance thermal barrier coating layer 9 will be developed, it is easy to change to the high-performance thermal barrier coating layer 9.

If the thermal barrier coating layer 9 is disposed vertically across the piston ring (combustion chamber-side piston ring 12A) which is positioned at the uppermost position of the cylinder liner 6 in the axial direction when the piston 5 reaches top dead center, when the piston 5 moves vertically along the axial direction, the piston ring 12 comes into slide contact with the thermal barrier coating layer 9, so that the thermal barrier coating layer 9 is damaged by the contact with the piston ring 12, and the thermal barrier performance of the thermal barrier coating layer 9 may decrease. In contrast, according to the above configuration, the thermal barrier coating layer 9 is disposed above the combustion chamber-side piston ring 12A when the piston 5 reaches top dead center. Accordingly, even when the piston 5 moves vertically along the axial direction, the piston ring 12 does not come into contact with the thermal barrier coating layer 9. Therefore, with the above-described thermal barrier coating member 7, it is possible to prevent the thermal barrier performance of the thermal barrier coating layer 9 from decreasing due to the contact with the piston ring 12, and it is possible to maintain the thermal barrier performance of the thermal barrier coating layer 9 for a long time. Thus, since the replacement frequency of the thermal barrier coating member 7 can be reduced, it is possible to suppress an increase in the cost for maintaining the thermal barrier performance of the thermal barrier coating layer 9.

In addition, the heat loss (heat input) from the combustion chamber 10 to the cylinder liner 6 is larger at an upper portion of the cylinder liner 6 (for example, the portion above the upper end 56 of the piston 5), which is exposed to heat for a long time in the combustion chamber 10, than at a lower portion of the cylinder liner 6. Therefore, sufficient thermal barrier effect can be obtained by the thermal barrier coating member 7 which insulates heat at the upper portion of the cylinder liner 6.

Hereinafter, with reference to FIGS. 5 to 12, some modification examples of the thermal barrier coating member 7 (7A) will be described. The thermal barrier coating member 7 described below has basically the same configuration as the thermal barrier coating member 7 (7A) described above. In the following modifications, the same features as those of the thermal barrier coating member 7(7A) are denoted by the same reference sings, and description thereof will be omitted. The characteristic features of each modification will be mainly described below.

Generally, when the piston 5 moves vertically along the axial direction in the cylinder liner 6, the piston 5 swings in the rotational direction about the axis CB of the piston pin 13 which rotatably supports the piston 5. If the upper portion of the piston 5 collides with the thermal barrier coating layer 9 due to the swinging motion of the piston 5, the thermal barrier coating layer 9 may be damaged.

FIGS. 5 to 8 are each an explanatory diagram for describing the first to fourth modification examples of the thermal barrier coating member according to an embodiment of the present disclosure. FIGS. 5 to 8 schematically show a cross-section of the engine 1 taken along the center axis CA of the cylinder liner 6.

In some embodiments, as shown in FIGS. 5 to 8, the base layer 8 includes a coated portion 84 on which the thermal barrier coating layer 9 is formed, and an exposed portion 85 on which the thermal barrier coating layer 9 is not formed. At least a part of the exposed portion 85 has a protrusion 86 which protrudes to the opposite side from the inner wall surface 61 with respect to the coated portion 84. Of the protrusions 86, the protrusion 86 formed at the lower end portion 83 of the base layer 8 in the axial direction is referred to as a lower protrusion 87.

In the embodiment shown in FIG. 5, the inside surface 82 of the base layer 8 has an upper inside surface 821 extending downward along the axial direction from the upper end of the base layer 8, a lower inside surface 822 disposed below the upper inside surface 821 and radially inward of the upper inside surface 821 and extending along the axial direction, and a step surface 823 connecting the lower end of the upper inside surface 821 and the upper end of the lower inside surface 822. The step surface 823 extends along a direction intersecting (e.g., perpendicular to) the axial direction. The thermal barrier coating layer 9 is formed from the upper end to the lower end of the upper inside surface 821 and is not formed on the lower inside surface 822. The lower inside surface 822 is disposed radially inward of the other surface 92 of the thermal barrier coating layer 9 facing the combustion chamber 10. In other words, the coated portion 84 includes the upper inside surface 821, and the protrusion 86 (lower protrusion 87) includes the lower inside surface 822.

Figure 6:
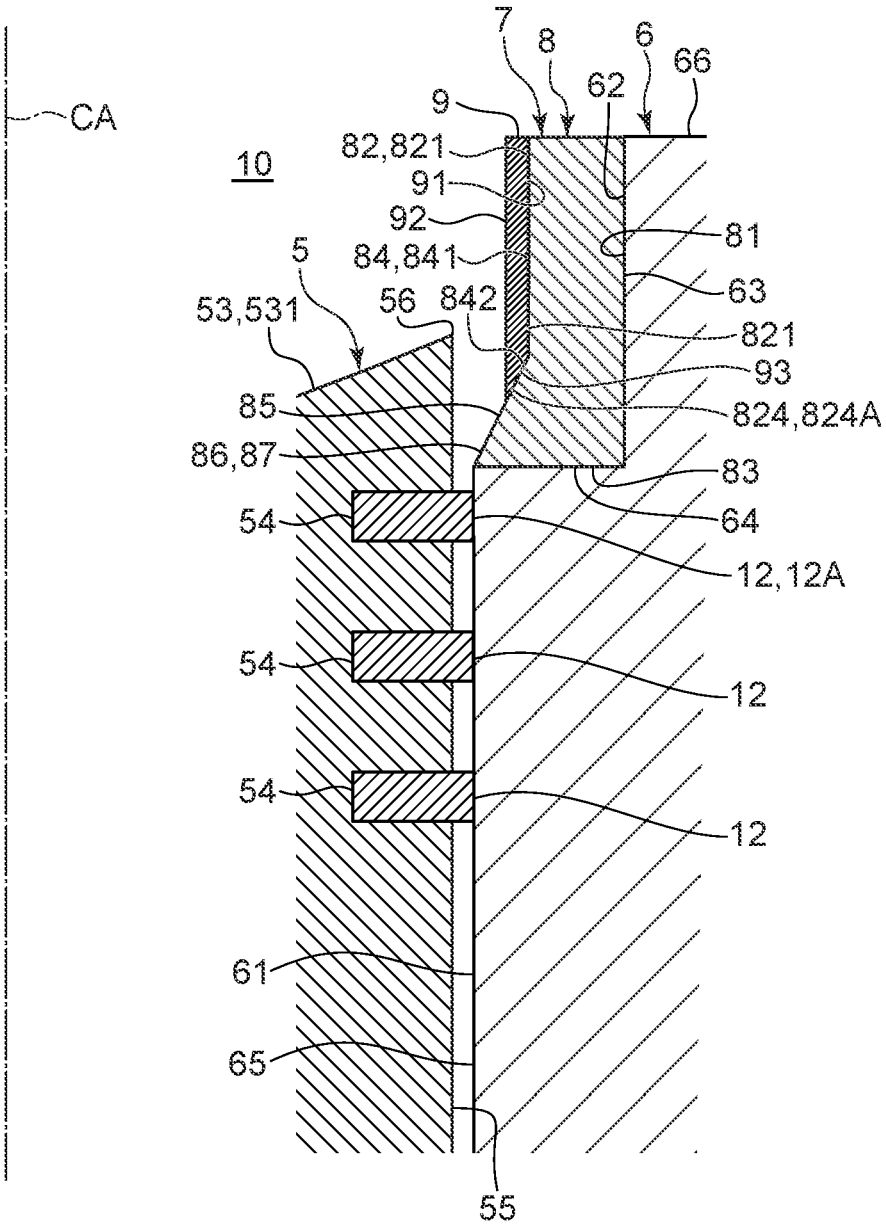
FIG. 6 is an explanatory diagram for describing the second modification example of the thermal barrier coating member according to an embodiment of the present disclosure.

In the embodiment shown in FIG. 6, the inside surface 82 of the base layer 8 has an upper inside surface 821 extending downward along the axial direction from the upper end of the base layer 8, and a lower inclined surface 824 inclined radially inward toward the lower side in the axial direction from the lower end of the upper inside surface 821. The thermal barrier coating layer 9 is formed from the upper end of the upper inside surface 821 to an upper portion 824A of the lower inclined surface 824 and is not formed on a lower portion of the lower inclined surface 824. The lower portion of the lower inclined surface 824 is disposed radially inward of the other surface 92 of the thermal barrier coating layer 9 facing the combustion chamber 10. In other words, the coated portion 84 includes the upper inside surface 821 and the upper portion 824A of the lower inclined surface 824, and the lower protrusion 87 (protrusion 86) includes the lower portion of the lower inclined surface 824.

Figure 7:
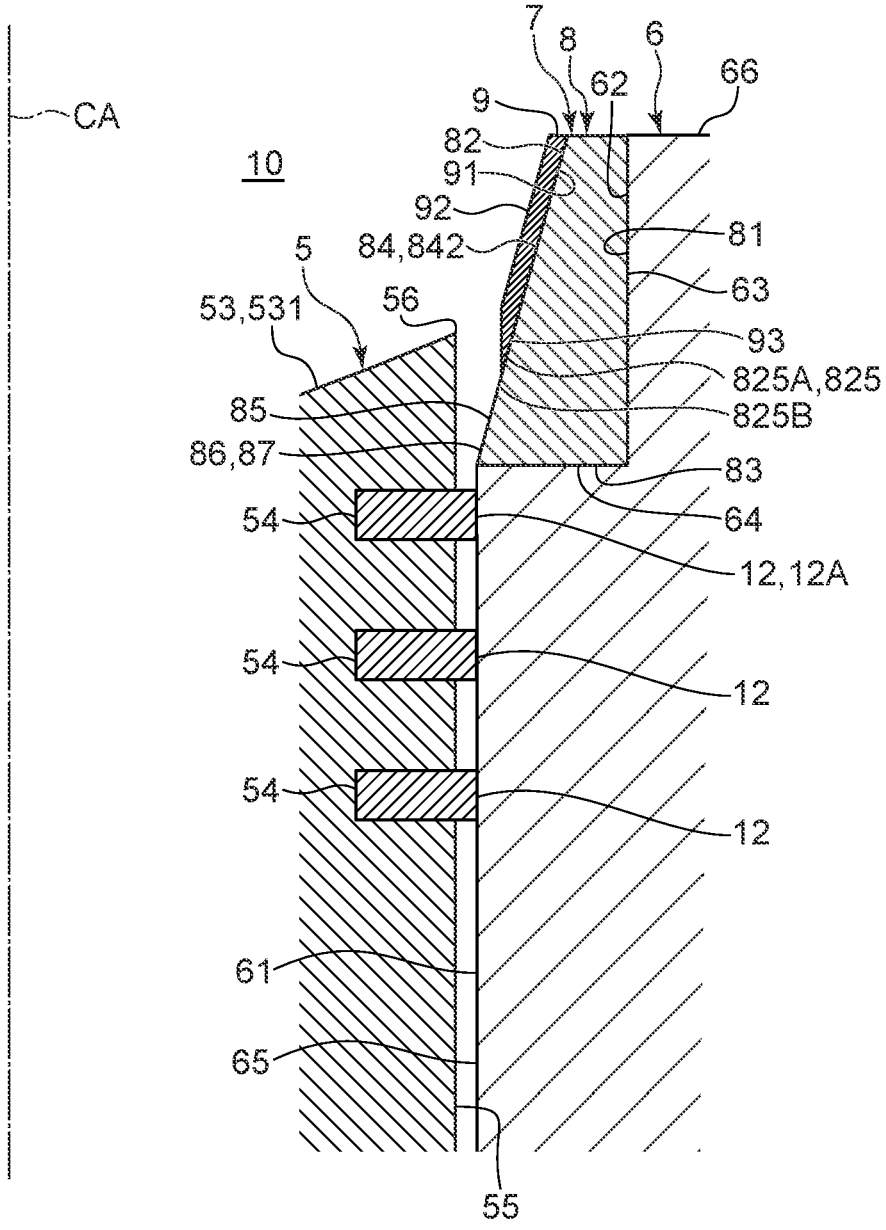
FIG. 7 is an explanatory diagram for describing the third modification example of the thermal barrier coating member according to an embodiment of the present disclosure.

In the embodiment shown in FIG. 7, the inside surface 82 of the base layer 8 has an inclined surface 825 formed from the upper end to the lower end of the base layer 8. The inclined surface 825 is inclined radially inward toward the lower side in the axial direction. The thermal barrier coating layer 9 is formed on an upper portion 825A of the inclined surface 825 and is not formed on a lower portion 825B of the inclined surface 825. In the illustrated embodiment, the thermal barrier coating layer 9 is formed on the inclined surface 825 from the upper end of the inclined surface 825 to the lower side of the center of the inclined surface 825. The lower portion 825B of the inclined surface 825 is disposed radially inward of the other surface 92 of the thermal barrier coating layer 9 facing the combustion chamber 10. In other words, the coated portion 84 includes the upper portion 825A of the inclined surface 825, and the lower protrusion 87 (protrusion 86) includes the lower portion 825B of the inclined surface 825.

In the embodiment shown in FIG. 8, the inside surface 82 of the base layer 8 has an upper inside surface 821 extending downward along the axial direction from the upper end of the base layer 8, a lower inside surface 822 disposed below the upper inside surface 821 and extending along the axial direction, a lower inclined surface 827 inclined radially inward toward the lower side in the axial direction from the lower end of the lower inside surface 826, and a protruding surface portion 828 disposed between the upper inside surface 821 and the lower inside surface 826 and protruding radially inward with respect to the upper inside surface 821 and the lower inside surface 826. In the illustrated embodiment, the protruding surface portion 828 has an upward inclined surface 828A inclined radially inward toward the lower side from the lower end of the upper inside surface 821, and a downward inclined surface 828B inclined radially inward toward the upper side from the upper end of the lower inside surface 826.

Figure 8:
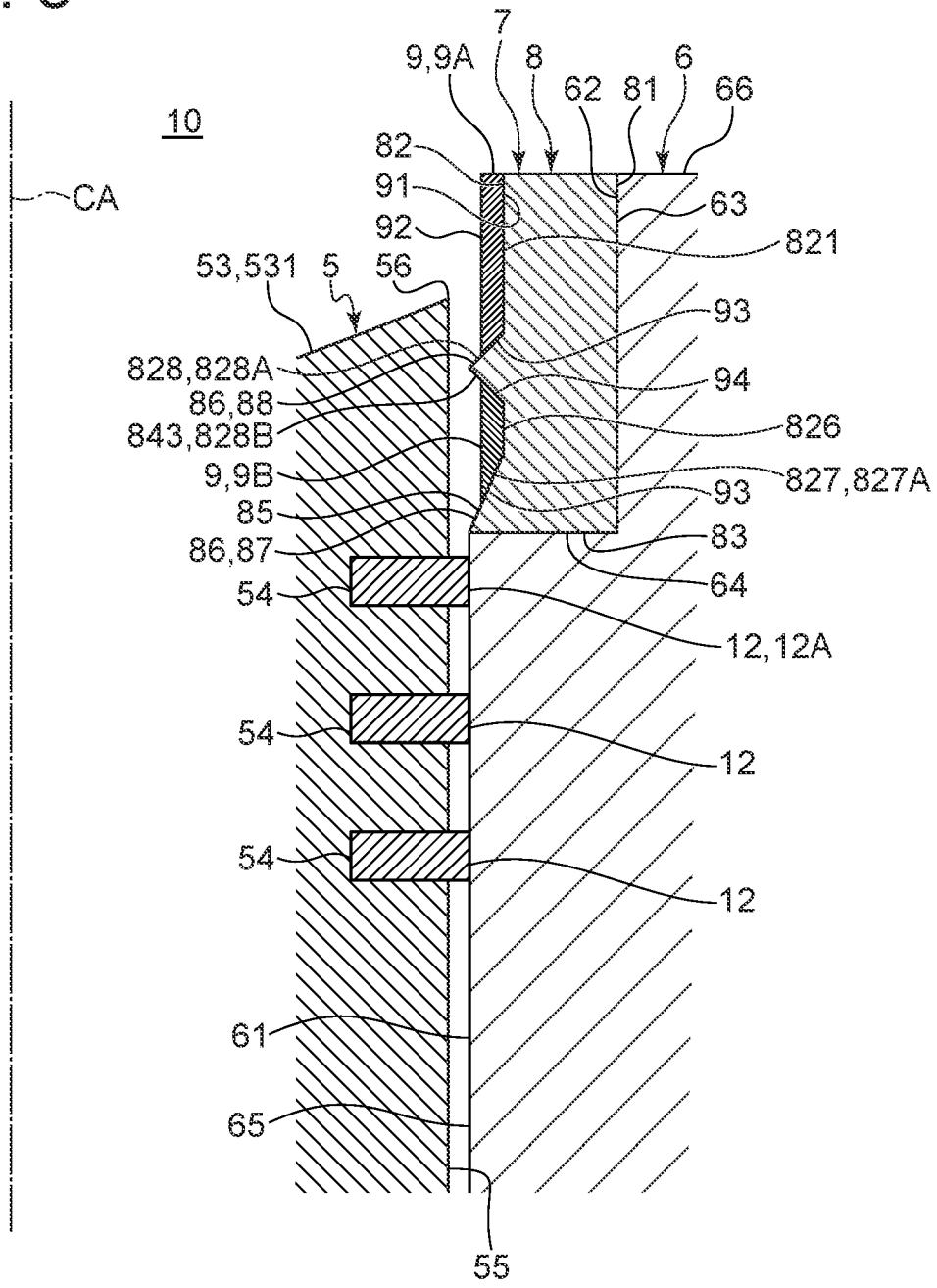
FIG. 8 is an explanatory diagram for describing the fourth modification example of the thermal barrier coating member according to an embodiment of the present disclosure.

In the embodiment shown in FIG. 8, the thermal barrier coating layer 9 has a first thermal barrier coating layer 9A formed on at least the upper inside surface 821 and a second thermal barrier coating layer 9B formed on at least the lower inside surface 826. In the illustrated embodiment, the first thermal barrier coating layer 9A is further formed on an upper portion of the upward inclined surface 828A. Further, the second thermal barrier coating layer 9B is further formed on a lower portion of the downward inclined surface 828B and an upper portion 827A of the lower inclined surface 827. A lower portion of the upward inclined surface 828A and an upper portion of the downward inclined surface 828B of the protruding surface portion 828 and the lower portion of the lower inclined surface 827 are disposed radially inward of the other surfaces 92 of the first thermal barrier coating layer 9A and the second thermal barrier coating layer 9B. In other words, the coated portion 84 includes the upper inside surface 821, the upper portion of the upward inclined surface 828A, and the lower portion of the downward inclined surface 828B, the lower inside surface 826, and the upper portion 827A of the lower inclined surface 827. The lower protrusion 87 includes the lower portion of the lower inclined surface 827, and the protrusion 86 further includes an upper protrusion 88 disposed above the lower protrusion 87 in the axial direction. In the illustrated embodiment, the upper protrusion 88 includes a tip portion of the protruding surface portion 828, that is, the lower portion of the upward inclined surface 828A and the upper portion of the downward inclined surface 828B.

According to the above configuration, the base layer 8 of the thermal barrier coating member 7 has the protrusion 86 which protrudes to the opposite side from the inner wall surface 61 with respect to the coated portion 84. In this case, when the piston 5 swings, the upper portion of the piston 5 collides with the protrusion 86 not coated with the thermal barrier coating layer 9, so that it is possible to prevent the upper portion of the piston 5 from colliding with the thermal barrier coating layer 9. By preventing the upper portion of the piston 5 from colliding with the thermal barrier coating layer 9, it is possible to maintain the thermal barrier performance of the thermal barrier coating layer 9 for a long time.

In some embodiments, as shown in FIGS. 5 to 8, the protrusion 86 includes the lower protrusion 87 formed at the lower end portion 83 of the base layer 8 in the axial direction, and the coated portion 84 is disposed above the lower protrusion 87 in the axial direction. According to the above configuration, the lower protrusion 87 is disposed below the coated portion 84 (thermal barrier coating layer 9) in the axial direction. In this case, when the piston 5 moves upward while swinging, the upper portion of the piston 5 collides with the lower protrusion 87 at an early stage. This restricts the swinging motion of the piston 5 and corrects the position of the piston 5. Thus, it is possible to effectively prevent the collision between the thermal barrier coating layer 9 disposed above the lower protrusion 87 and the upper portion of the piston 5.

Figure 5:
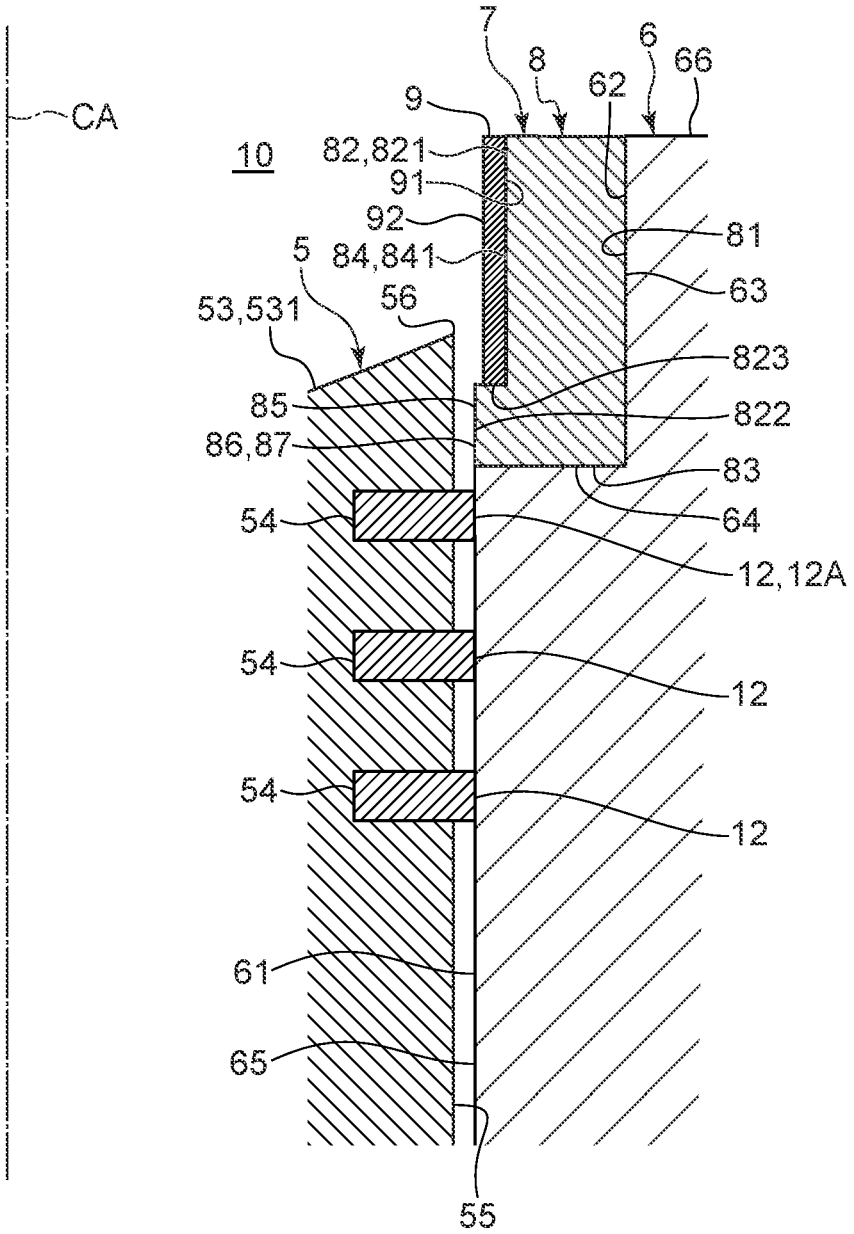
FIG. 5 is an explanatory diagram for describing the first modification example of the thermal barrier coating member according to an embodiment of the present disclosure.

In some embodiments, as shown in FIGS. 5, 6, and 8, the coated portion 84 has a first inner surface 841 extending along the axial direction. The upper inside surface 821 in FIGS. 5 and 6 corresponds to the first inner surface 841. Further, each of the upper inside surface 821 and the lower inside surface 826 in FIG. 8 corresponds to the first inner surface 841.

According to the above configuration, the coated portion 84 has the first inner surface 841 extending along the axial direction. The thickness of the thermal barrier coating layer 9 formed on the first inner surface 841 can be easily made uniform at the time of film formation. By making the thickness of the thermal barrier coating layer 9 uniform, it is possible to prevent the thermal barrier performance from varying with the position of the thermal barrier coating layer 9, so that it is possible to effectively exhibit the thermal barrier effect of the thermal barrier coating layer 9.

In some embodiments, as shown in FIGS. 6 to 8, the coated portion 84 has a second inner surface 842 inclined such that a distance from the center axis CA of the cylinder liner 6 increases toward the upper side in the axial direction. Each of the upper portion 824A of the lower inclined surface 824 in FIG. 6 and the upper portion 825A of the inclined surface 825 in FIG. 7 corresponds to the second inner surface 842. Further, each of the upper portion of the upward inclined surface 828A and the upper portion 827A of the lower inclined surface 827 in FIG. 8 corresponds to the second inner surface 842.

According to the above configuration, the coated portion 84 has the second inner surface 842 inclined such that a distance from the center axis CA of the cylinder liner 6 increases toward the upper side in the axial direction. The thermal barrier coating layer 9 formed on the second inner surface 842 can be easily tapered toward the lower end at the time of film formation of the lower edge 93. By forming the lower edge 93 of the thermal barrier coating layer 9 in a tapered shape, it is possible to prevent the thermal barrier coating layer 9 from separating from the base layer 8. By preventing the separation of the thermal barrier coating layer 9 from the base layer 8, it is possible to maintain the thermal barrier performance of the thermal barrier coating layer 9 for a long time. Thus, since the replacement frequency of the thermal barrier coating member 7 can be reduced, it is possible to suppress an increase in the cost for maintaining the thermal barrier performance of the thermal barrier coating layer 9.

In the embodiments shown in FIGS. 6 to 8, the coated portion 84 has the second inner surface 842, and the lower edge 93 of the thermal barrier coating layer 9 has a tapered shape. In this case, as compared to the case w % here the thermal barrier coating layer 9 has a uniform thickness, the thermal barrier coating layer 9 can be formed to the lower side of the base layer 8 while suppressing an increase in the gap between the outer peripheral surface 55 of the piston 5 and the inside surface 82 of the base layer 8. By reducing the gap, the heat loss in the combustion chamber 10 due to the gap can be reduced.

In some embodiments, as shown in FIG. 8, the coated portion 84 has a third inner surface 843 inclined such that a distance from the center axis CA of the cylinder liner 6 increases toward the lower side in the axial direction. The lower portion of the downward inclined surface 828B in FIG. 8 corresponds to the third inner surface 843.

According to the above configuration, the coated portion 84 has the third inner surface 843 inclined such that a distance from the center axis CA of the cylinder liner 6 increases toward the lower side in the axial direction. The thermal barrier coating layer 9 formed on the third inner surface 843 can be easily tapered toward the upper end at the time of film formation of the upper edge 94. By forming the upper edge 94 of the thermal barrier coating layer 9 in a tapered shape, it is possible to prevent the thermal barrier coating layer 9 from separating from the base layer 8. By preventing the separation of the thermal barrier coating layer 9 from the base layer 8, it is possible to maintain the thermal barrier performance of the thermal barrier coating layer 9 for a long time. Thus, since the replacement frequency of the thermal barrier coating member 7 can be reduced, it is possible to suppress an increase in the cost for maintaining the thermal barrier performance of the thermal barrier coating layer 9.

In some embodiments, as shown in FIG. 8, the protrusion 86 includes the lower protrusion 87, and the upper protrusion 88 disposed above the lower protrusion 87 in the axial direction. As shown in FIG. 8, at least a part (the whole in the illustrated example) of the upper protrusion 88 is positioned below the upper end 56 of the piston 5 when the piston 5 reaches top dead center. According to the above configuration, the protrusion 86 includes the lower protrusion 87 and the upper protrusion 88 disposed above the lower protrusion 87 in the axial direction. In this case, by making the upper portion of the piston 5 to collide with either of the upper protrusion 88 or the lower protrusion 87, which are at different axial positions, it is possible to effectively prevent the collision between the thermal barrier coating layer 9 and the upper portion of the piston 5.

In some embodiments, as shown in FIGS. 6 to 8, the thermal barrier coating layer 9 is configured such that at least one of the upper edge 94 or the lower edge 93 is tapered toward the tip side. According to the above configuration, since the thermal barrier coating layer 9 is configured such that at least one of the upper edge 94 or the lower edge 93 is tapered toward the tip side, it is possible to prevent the upper edge 94 or the lower edge 93 from separating from the base layer 8. By preventing the separation of the thermal barrier coating layer 9 from the base layer 8, it is possible to maintain the thermal barrier performance of the thermal barrier coating layer 9 for a long time. Thus, since the replacement frequency of the thermal barrier coating member 7 can be reduced, it is possible to suppress an increase in the cost for maintaining the thermal barrier performance of the thermal barrier coating layer 9.

Figure 9:
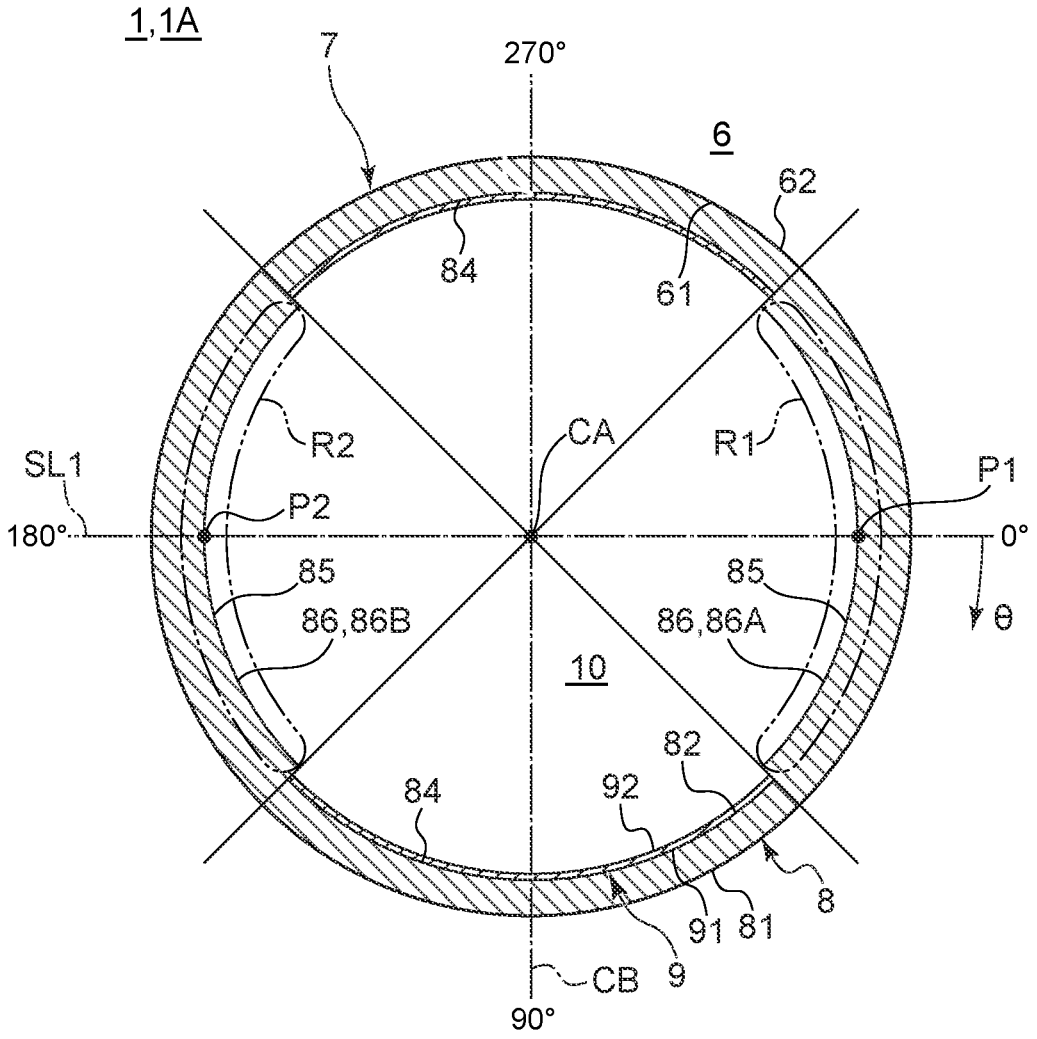
FIG. 9 is an explanatory diagram for describing the fifth modification example of the thermal barrier coating member according to an embodiment of the present disclosure.
Figure 10:
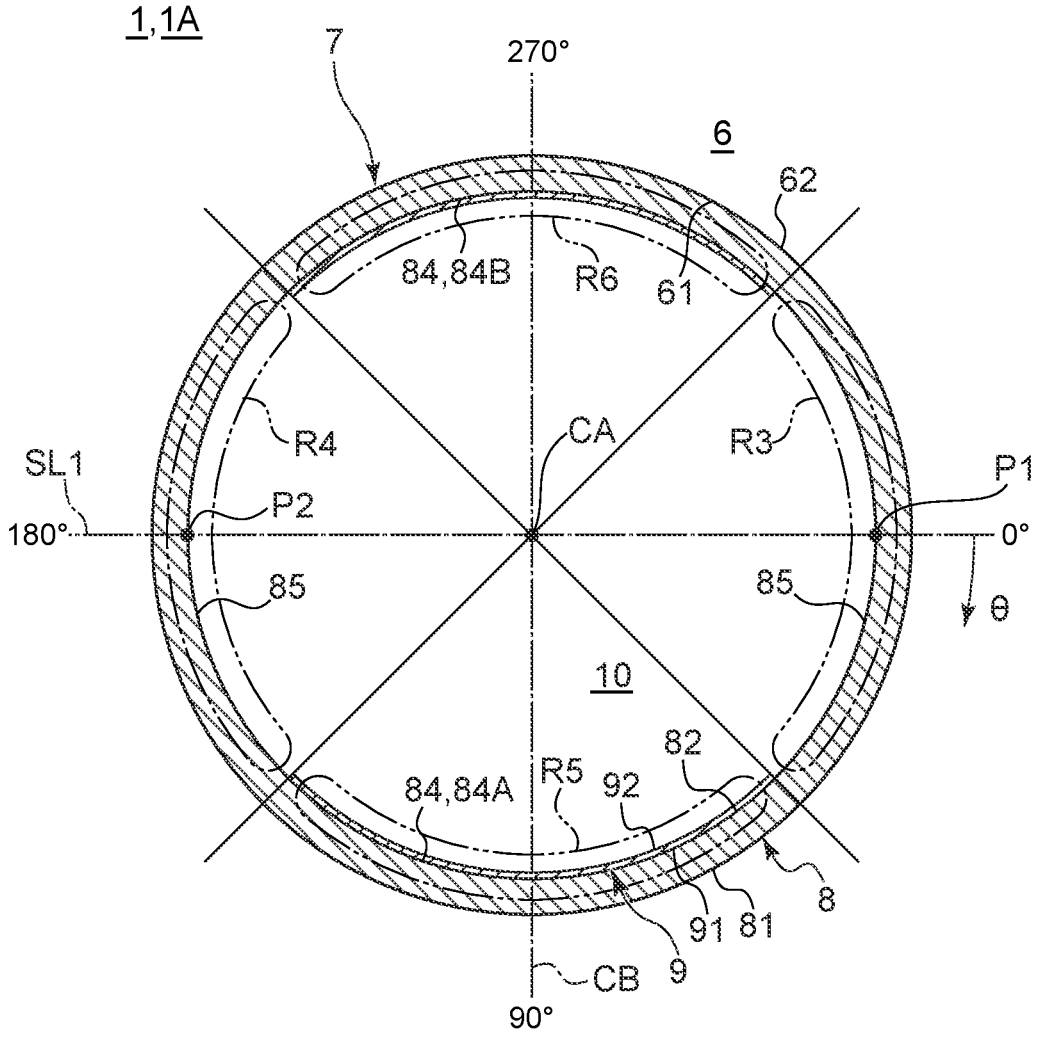
FIG. 10 is an explanatory diagram for describing the sixth modification example of the thermal barrier coating member according to an embodiment of the present disclosure.
Figure 11:
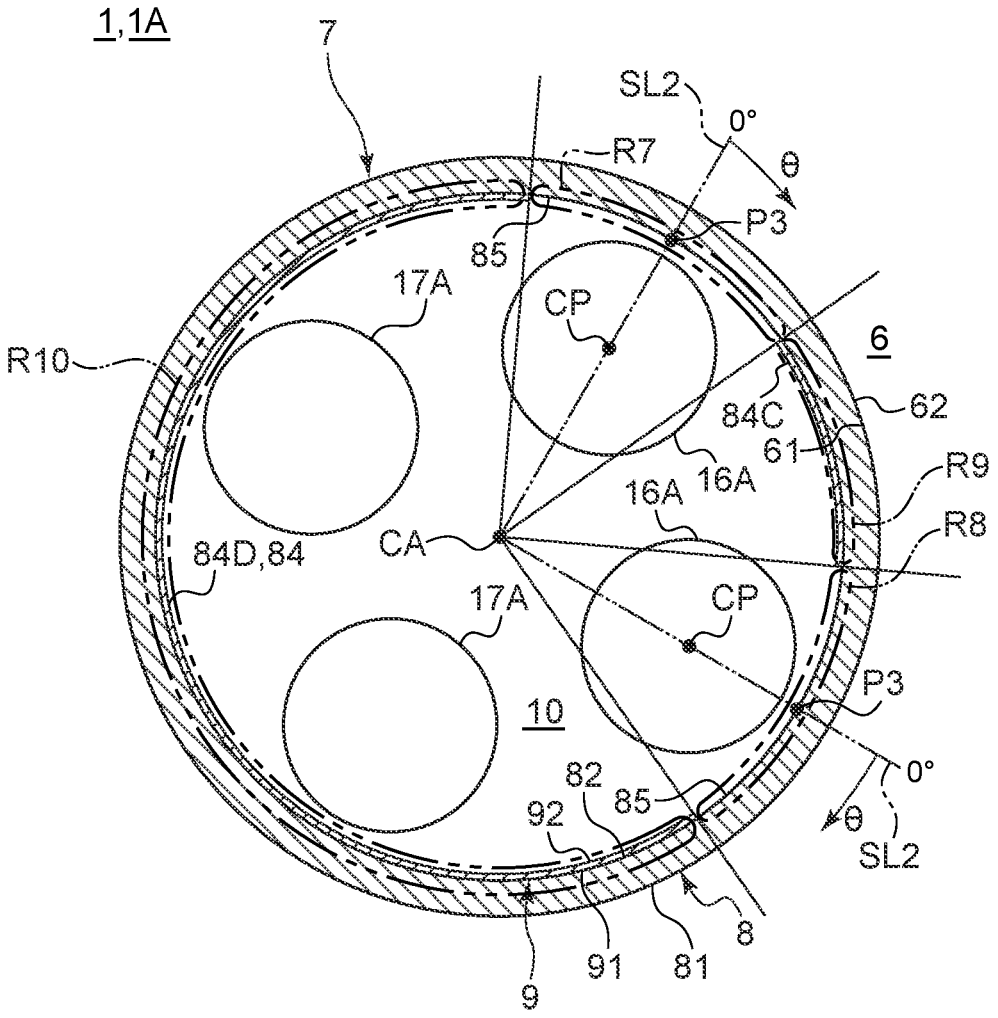
FIG. 11 is an explanatory diagram for describing the seventh modification example of the thermal barrier coating member according to an embodiment of the present disclosure.

FIGS. 9 to 12 are each an explanatory diagram for describing the fifth to eighth modification examples of the thermal barrier coating member according to an embodiment of the present disclosure. FIGS. 9 to 12 schematically show a plan view of the engine 1 when the combustion chamber 10 is viewed from below in the axial direction. In FIGS. 9 to 11, the hatching of the cylinder liner 6 is omitted.

In some embodiments, as shown in FIG. 9, in a plan view of the combustion chamber 10 viewed from below in the axial direction, the protrusion 86 is formed in a predetermined range R1, R2 (a range of at least +30°) in the circumferential direction of the cylinder liner 6 with respect to a first straight line SL1 extending from the center axis CA of the cylinder liner 6 in the direction perpendicular to the axis CB of the piston pin 13. In the illustrated embodiment, the base layer 8 does not have the protrusion 86 in the pair of ranges between the predetermined range R1 and the predetermined range R2 in the circumferential direction of the cylinder liner 6.

In FIG. 9, in the above-described plan view, of the intersections P1 and P2 between the first straight line SL1 and the inside surface 82 of the base layer 8, the position of one intersection P1 is defined as the 0° position, the clockwise direction about the center axis CA is defined as the forward direction, and the circumferential angle in the forward direction with respect to the 0° position is defined as θ.

In the embodiment shown in FIG. 9, the protrusion 86 includes a one-side protrusion 86A formed in the predetermined range R1 based on the 0° position and an other-side protrusion 86B formed in the predetermined range R2 based on the 180° position. As each of the predetermined ranges R1, R2 is enlarged, the possibility that the protrusion 86 collides with the upper portion of the piston 5 is increased, but the area where the thermal barrier coating layer 9 is formed on the base layer 8 is reduced, so that the thermal barrier effect of the thermal barrier coating layer 9 is reduced.

In the illustrated embodiment, the one-side protrusion 86A is formed at least in the range of $-30° \leq \theta \leq 30°$. The other-side protrusion 86B is formed at least in the range of $150° \leq \theta \leq 210°$. The predetermined range R1, R2 may be, for example, a range of ±30° or a range of +45°.

Since the piston 5 swings in the direction perpendicular to the axis CB of the piston pin 13, there is a high possibility that the upper portion of the piston 5 collides with the thermal barrier coating member 7 in the predetermined range R1, R2 (for example, ±30°) in the circumferential direction of the cylinder liner 6 with respect to the first straight line SL1 extending in the direction perpendicular to the axis CB of the piston pin 13. According to the above configuration, since the protrusion 86 (one-side protrusion 86A and other-side protrusion 86B) is formed in the predetermined range R1, R2 where the upper portion of the piston 5 is likely to collide with the thermal barrier coating member 7 to make the upper portion of the piston 5 to collide with the protrusion 86, it is possible to effectively prevent the collision between the thermal barrier coating layer 9 and the upper portion of the piston 5.

Further, in the above-described thermal barrier coating member 7, since the protrusion 86 is formed in a limited range in the circumferential direction of the cylinder liner 6, as compared to the case where the protrusion 86 is formed over the entire circumference in the circumferential direction of the cylinder liner 6, the area where the thermal barrier coating layer 9 is formed on the base layer 8 can be enlarged, so that the thermal barrier effect of the thermal barrier coating layer 9 can be improved.

In some embodiments, as shown in FIG. 10, the base layer 8 includes a coated portion 84 on which the thermal barrier coating layer 9 is formed, and an exposed portion 85 on which the thermal barrier coating layer 9 is not formed. As shown in FIG. 10, in a plan view of the combustion chamber 10 viewed from below in the axial direction, the coated portion 84 is formed out of a predetermined range R3, R4 (e.g., a range of 30°) in the circumferential direction of the cylinder liner 6 with respect to a first straight line SL extending from the center axis CA of the cylinder liner 6 in the direction perpendicular to the axis CB of the piston pin 13. In the illustrated embodiment, the base layer 8 does not have the coated portion 84 in the predetermined range R3 and the predetermined range R4 in the circumferential direction of the cylinder liner 6.

In FIG. 10, as in FIG. 9, in the above-described plan view, of the intersections P1 and P2 between the first straight line SL1 and the inside surface 82 of the base layer 8, the position of one intersection P1 is defined as the 0° position, the clockwise direction about the center axis CA is defined as the forward direction, and the circumferential angle in the forward direction with respect to the 0° position is defined as θ.

In the embodiment shown in FIG. 10, the coated portion 84 includes a one-side coated portion 84A formed in one range R5 of a pair of ranges R5, R6 between the predetermined range R3 based on the 0° position and the predetermined range R4 based on the 180° position in the circumferential direction of the cylinder liner 6, and an other-side coated portion 84B formed in the other range R6. As each of the predetermined ranges R3, R4 where the coated portion 84 is not formed is enlarged, the possibility that the upper portion of the piston 5 collides with the thermal barrier coating layer 9 is decreased, but the area where the thermal barrier coating layer 9 is formed on the base layer 8 is reduced, so that the thermal barrier effect of the thermal barrier coating layer 9 is reduced.

In the illustrated embodiment, the one-side coated portion 84A is formed at least in the range of 6°≤θ≤120°. The other-side coated portion 84B is formed at least in the range of 240°≤θ≤0300°. The predetermined range R3, R4 may be, for example, a range of ±30° or a range of ±45°.

Since the piston 5 swings in the direction perpendicular to the axis CB of the piston pin 13, there is a high possibility that the upper portion of the piston 5 collides with the thermal barrier coating member 7 in the predetermined range R3, R4 (for example, ±30°) in the circumferential direction of the cylinder liner 6 with respect to the first straight line SL1 extending in the direction perpendicular to the axis CB of the piston pin 13. If the thermal barrier coating layer 9 is separated from the base layer 8 due to the collision between the upper portion of the piston 5 and the thermal barrier coating layer 9 of the thermal barrier coating member 7, the vicinity of the separated portion becomes easy to separate, so that the separation of the thermal barrier coating layer 9 from the base layer 8 may progress, and the thermal barrier performance of the thermal barrier coating layer 9 may deteriorate at an early stage. According to the above configuration, since the coated portion 84 is not formed in the predetermined range R3, R4 (for example, ±30°) where the upper portion of the piston 5 is likely to collide with the thermal barrier coating member 7, it is possible to effectively prevent the collision between the thermal barrier coating layer 9 and the upper portion of the piston 5. By preventing the collision between the thermal barrier coating layer 9 and the upper portion of the piston 5, it is possible to prevent the thermal barrier coating layer 9 from separating from the base layer 8, so that it is possible to maintain the thermal barrier performance of the thermal barrier coating layer 9 for a long time.

In some embodiments, as shown in FIG. 11, the base layer 8 includes a coated portion 84 on which the thermal barrier coating layer 9 is formed, and an exposed portion 85 on which the thermal barrier coating layer 9 is not formed. As shown in FIG. 11, in a plan view of the combustion chamber 10 viewed from below in the axial direction, the coated portion 84 is formed out of a predetermined range R7, R8 (e.g., a range of ±15°) in the circumferential direction of the cylinder liner 6 with respect to a second straight line SL2 extending from the center axis CA of the cylinder liner 6 and passing through the center CP of the intake port 16A.

In FIG. 11, in the above-described plan view, the position of the intersection P3 between the second straight line SL2 and the inside surface 82 of the base layer 8 is defined as the 0° position, the clockwise direction about the center axis CA is defined as the forward direction, and the circumferential angle in the forward direction with respect to the 0° position is defined as θ.

In the embodiment shown in FIG. 11, two intake ports 16A are formed on the lower surface 42 of the cylinder head 4 at separate positions in the circumferential direction of the cylinder liner 6. The coated portion 84 is not formed in a predetermined range R7 in the circumferential direction of the cylinder liner 6 with respect to the second straight line SL2 passing through the center CP of one of the intake ports 16A and a predetermined ranges R8 in the circumferential direction of the cylinder liner 6 with respect to the second straight line SL2 passing through the center CP of the other intake port 16A.

In the embodiment shown in FIG. 11, the coated portion 84 includes a one-side coated portion 84C formed in a narrower range R9 of a pair of ranges R9, R10 between the predetermined range R7 and the predetermined range R8 in the circumferential direction of the cylinder liner 6, and an other-side coated portion 84D formed in the other wider range R10. As each of the predetermined ranges R7, R8 where the coated portion 84 is not formed is enlarged, the transfer of heat stored in the thermal barrier coating layer 9 to the combustion gas is suppressed, but the area where the thermal barrier coating layer 9 is formed on the base layer 8 is reduced, so that the thermal barrier effect of the thermal barrier coating layer 9 is reduced. The predetermined range R7, R8 may be, for example, a range of ±30° or a range of ±45°.

If the thermal barrier coating layer 9 is disposed in the vicinity of the intake port 16A, the combustion gas (e.g., combustion air) introduced into the combustion chamber 10 through the intake port 16A may be heated and expanded by heat stored in the thermal barrier coating layer 9 before combustion, resulting in a decrease in combustion efficiency. According to the above configuration, the thermal barrier coating layer 9 does not have the coated portion 84 in the vicinity of the intake port 16A, i.e., in a plan view of the combustion chamber 10 viewed from below in the axial direction, in the predetermined range R7, R8 (e.g., a range of +15°) in the circumferential direction of the cylinder liner 6 with respect to the second straight line SL2 extending from the center axis CA of the cylinder liner 6 and passing through the center CP of the intake port 16A, but has the coated portion 84 in the range R9. R10 other than the predetermined range R7, R8. Thus, since the coated portion 84 is not formed in the vicinity of the intake port 16A, the combustion gas introduced into the combustion chamber 10 through the intake port 16A is prevented from being heated by heat stored in the thermal barrier coating layer 9 before combustion, suppressing a decrease in combustion efficiency.

Figure 12:
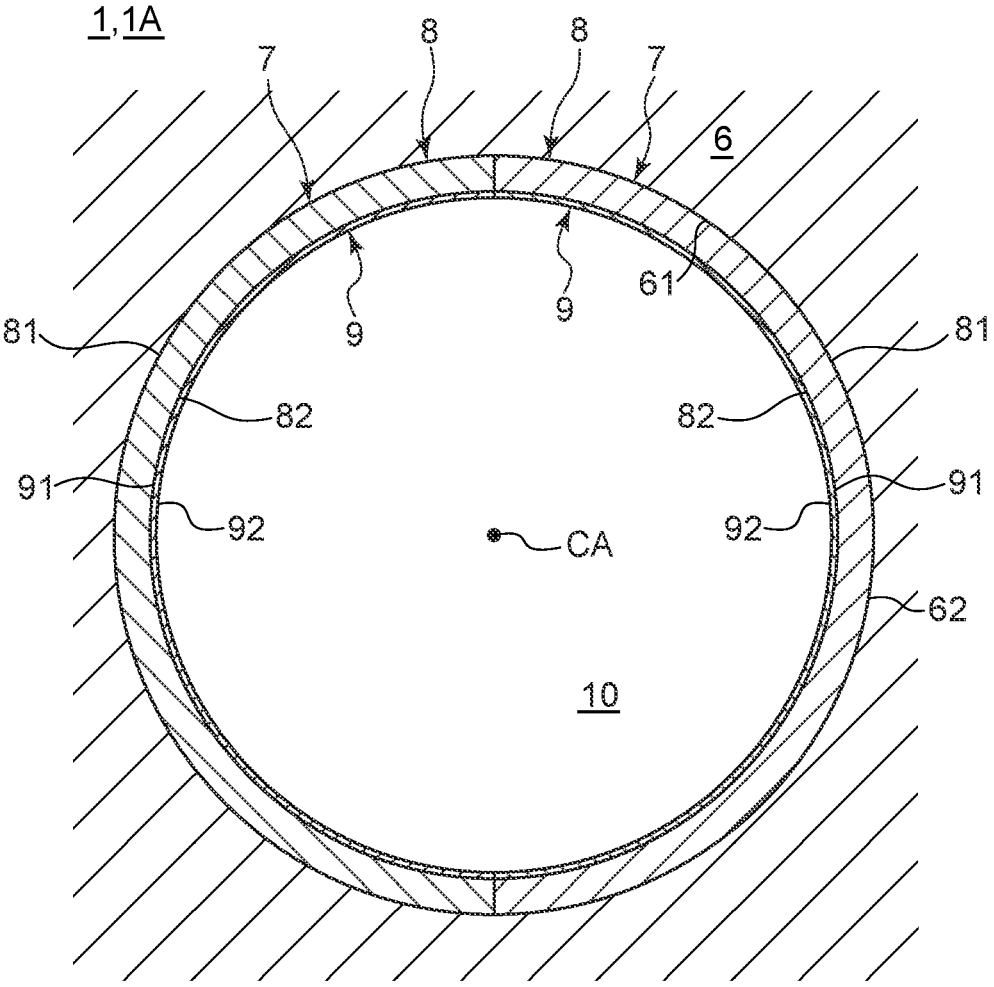
FIG. 12 is an explanatory diagram for describing the eighth modification example of the thermal barrier coating member according to an embodiment of the present disclosure.

In the above-described embodiments, for example as shown in FIG. 4, the base layer 8 of the thermal barrier coating member 7 is formed in an annular shape extending along the circumferential direction of the cylinder liner 6. However, as shown in FIG. 12, it may be formed in an arc shape (semicircular shape in the illustrated example) extending along the circumferential direction of the cylinder liner 6. As shown in FIG. 12, a plurality of (two in the illustrated example) thermal barrier coating members 7 may be detachably fitted into the recess 62 of the cylinder liner 6. Further, the recess 62 of the cylinder liner 6 may be an arc-shaped groove extending along the circumferential direction of the cylinder liner 6.

The present disclosure is not limited to the embodiments described above, but includes modifications to the embodiments described above, and embodiments composed of combinations of those embodiments. For example, the engine 1 on which the thermal barrier coating member 7 is mounted may be used for any of a marine engine, a power generation engine, and an automobile engine. When the engine 1 is a marine engine or a power generation engine, since the engine is operated for a long period of time, replacement work and maintenance work are required more frequently than in an automobile engine, and the replacement work and the maintenance work need to be performed quickly. Therefore, the present invention is particularly useful for a marine engine and a power generation engine.

The contents described in the above embodiments would be understood as follows, for instance.

1) A thermal barrier coating member (7) according to at least one embodiment of the present disclosure is at least one thermal barrier coating member (7) mounted on an inner wall surface (61), facing a combustion chamber (10) of an engine (1), of a cylinder liner (6) accommodating a piston (5) slidably along an axial direction. The thermal barrier coating member (7) comprises, a base layer (8) configured to be detachably fitted into a recess (62) formed in the inner wall surface (61) of the cylinder liner (6); and a thermal barrier coating layer (9) formed on an opposite side (inside surface 82) of the base layer (8) from the inner wall surface (61) of the cylinder liner (6). The thermal barrier coating layer (9) is disposed above a piston ring (combustion chamber-side piston ring 12A) which is positioned at an uppermost position in the axial direction of the cylinder liner (6) when the piston (5) reaches top dead center.

According to the above configuration 1), the thermal barrier coating member (7) includes the base layer (8) and the thermal barrier coating layer (9) formed on the opposite side (inside surface 82) of the base layer (8) from the inner wall surface (61) of the cylinder liner (6). Further, the base layer (8) of the thermal barrier coating member (7) is configured to be detachably fitted into the recess (62) of the cylinder liner (6). Accordingly, by replacing the thermal barrier coating member (7), the thermal barrier coating layer (9) can be replaced without replacing the cylinder liner (6). In contrast, when the thermal barrier coating layer (9) is directly formed on the cylinder liner (6), the cylinder liner (6) needs to be replaced in order to replace the thermal barrier coating layer (9). Thus, with the above-described thermal barrier coating member (7), since the thermal barrier coating layer (9) can be replaced without replacing the cylinder liner (6), as compared to the case where the thermal barrier coating layer (9) is directly formed on the cylinder liner (6), it is possible to suppress an increase in the cost for maintaining the thermal barrier performance of the thermal barrier coating layer (9).

If the thermal barrier coating layer (9) is disposed vertically across the piston ring (combustion chamber-side piston ring 12A) which is positioned at the uppermost position of the cylinder liner (6) in the axial direction when the piston (5) reaches top dead center, when the piston (5) moves vertically along the axial direction, the piston ring (12) comes into slide contact with the thermal barrier coating layer (9), so that the thermal barrier coating layer (9) is damaged by the contact with the piston ring (12), and the thermal barrier performance of the thermal barrier coating layer (9) may decrease. In contrast, according to the above configuration 1), the thermal barrier coating layer (9) is disposed above the combustion chamber-side piston ring (12A) when the piston (5) reaches top dead center. Accordingly, even when the piston (5) moves vertically along the axial direction, the piston ring (12) does not come into contact with the thermal barrier coating layer (9). Therefore, with the above-described thermal barrier coating member (7), it is possible to prevent the thermal barrier performance of the thermal barrier coating layer (9) from decreasing due to the contact with the piston ring (12), and it is possible to maintain the thermal barrier performance of the thermal barrier coating layer (9) for along time. Thus, since the replacement frequency of the thermal barrier coating member (7) can be reduced, it is possible to suppress an increase in the cost for maintaining the thermal barrier performance of the thermal barrier coating layer (9).

2) In some embodiments, in the thermal barrier coating member (7) described in 1), the base layer (8) includes: a coated portion (84) on which the thermal barrier coating layer (9) is formed; and an exposed portion (85) on which the thermal barrier coating layer (9) is not formed. At least a part of the exposed portion (85) has a protrusion (86) which protrudes to the opposite side from the inner wall surface (61) with respect to the coated portion (84).

Generally, when the piston (5) moves vertically along the axial direction in the cylinder liner (6), the piston (5) swings in the rotational direction about the axis of the piston pin (13). If the upper portion of the piston (5) collides with the thermal barrier coating layer (9) due to the swinging motion of the piston (5), the thermal barrier coating layer (9) may be damaged. According to the above configuration 2), the base layer (8) of the thermal barrier coating member (7) has the protrusion (86) which protrudes to the opposite side from the inner wall surface (61) with respect to the coated portion (84). In this case, when the piston (5) swings, the upper portion of the piston (5) collides with the protrusion (86) not coated with the thermal barrier coating layer (9), so that it is possible to prevent the upper portion of the piston (5) from colliding with the thermal barrier coating layer (9). By preventing the upper portion of the piston (5) from colliding with the thermal barrier coating layer (9), it is possible to maintain the thermal barrier performance of the thermal barrier coating layer (9) for a long time.

3) In some embodiments, in the thermal barrier coating member (7) described in 2), the protrusion (86) includes a lower protrusion (87) formed at a lower end portion of the base layer (8) in the axial direction. The coated portion (84) is disposed above the lower protrusion (87) in the axial direction.

According to the above configuration 3), the lower protrusion (87) is disposed below the coated portion (84) in the axial direction. In this case, when the piston (5) moves upward while swinging, the upper portion of the piston (5) collides with the lower protrusion (87) at an early stage. This restricts the swinging motion of the piston (5) and corrects the position of the piston (5). Thus, it is possible to effectively prevent the collision between the thermal barrier coating layer (9) and the upper portion of the piston (5).

4) In some embodiments, in the thermal barrier coating member (7) described in 3), the coated portion (84) has a first inner surface (841) extending along the axial direction.

According to the above configuration 4), the coated portion (84) has the first inner surface (841) extending along the axial direction. The thickness of the thermal barrier coating layer (9) formed on the first inner surface (841) can be easily made uniform at the time of film formation. By making the thickness of the thermal barrier coating layer (9) uniform, it is possible to prevent the thermal barrier performance from varying with the position of the thermal barrier coating layer (9), so that it is possible to effectively exhibit the thermal barrier effect of the thermal barrier coating layer (9).

5) In some embodiments, in the thermal barrier coating member (7) described in 3) or 4), the coated portion (84) has a second inner surface (842) inclined such that a distance from a center axis (CA) of the cylinder liner (6) increases toward an upper side in the axial direction.

According to the above configuration 5), the coated portion (84) has the second inner surface (842) inclined such that a distance from the center axis (CA) of the cylinder liner (6) increases toward the upper side in the axial direction. The thermal barrier coating layer (9) formed on the second inner surface (842) can be easily tapered toward the lower end at the time of film formation of the lower edge (93). By forming the lower edge (93) of the thermal barrier coating layer (9) in a tapered shape, it is possible to prevent the thermal barrier coating layer (9) from separating from the base layer (8). By preventing the separation of the thermal barrier coating layer (9) from the base layer (8), it is possible to maintain the thermal barrier performance of the thermal barrier coating layer (9) for a long time. Thus, since the replacement frequency of the thermal barrier coating member (7) can be reduced, it is possible to suppress an increase in the cost for maintaining the thermal barrier performance of the thermal barrier coating layer (9).

6) In some embodiments, in the thermal barrier coating member (7) described in any one of 3) to 5), the protrusion (86) further includes an upper protrusion (88) disposed above the lower protrusion (87) in the axial direction.

According to the above configuration 6), the protrusion (86) includes the lower protrusion (87) and the upper protrusion (88) disposed above the lower protrusion (87) in the axial direction. In this case, by making the upper portion of the piston (5) to collide with either of the upper protrusion (87) or the lower protrusion (87), which are at different axial positions, it is possible to effectively prevent the collision between the thermal barrier coating layer (9) and the upper portion of the piston (5).

7) In some embodiments, in the thermal barrier coating member (7) described in any one of 2) to 6), in a plan view of the combustion chamber (10) viewed from below in the axial direction, the protrusion (86) is formed within a range of at least 30° in a circumferential direction of the cylinder liner (6) with respect to a first straight line (SL1) extending from a center axis (CA) of the cylinder liner (6) in a direction perpendicular to an axis (CB) of a piston pin (13) which rotatably supports the piston (5).

Since the piston (5) swings in the direction perpendicular to the axis (CB) of the piston pin (13), there is a high possibility that the upper portion of the piston (5) collides with the thermal barrier coating member (7) in the predetermined range (R1, R2 (for example, 30°)) in the circumferential direction of the cylinder liner (6) with respect to the first straight line (SL1) extending in the direction perpendicular to the axis (CB) of the piston pin (13). According to the above configuration 7), since the protrusion (86) is formed in the predetermined range (R1, R2) where the upper portion of the piston (5) is likely to collide with the thermal barrier coating member (7) to make the upper portion of the piston (5) to collide with the protrusion (86), it is possible to effectively prevent the collision between the thermal barrier coating layer (9) and the upper portion of the piston (5).

8) In some embodiments, in the thermal barrier coating member (7) described in any one of 1) to 7), at least one of an upper edge (94) or a lower edge (93) of the thermal barrier coating layer (9) is tapered toward a tip side.

According to the above configuration 8), since the thermal barrier coating layer (9) is configured such that at least one of the upper edge (94) or the lower edge (93) is tapered toward the tip side, it is possible to prevent the upper edge (94) or the lower edge (93) from separating from the base layer (8). By preventing the separation of the thermal barrier coating layer (9) from the base layer (8), it is possible to maintain the thermal barrier performance of the thermal barrier coating layer (9) for a long time. Thus, since the replacement frequency of the thermal barrier coating member (7) can be reduced, it is possible to suppress an increase in the cost for maintaining the thermal barrier performance of the thermal barrier coating layer (9).

9) In some embodiments, in the thermal barrier coating member (7) described in any one of 1) to 8), the base layer (8) includes: a coated portion (84) on which the thermal barrier coating layer (9) is formed; and an exposed portion (85) on which the thermal barrier coating layer (9) is not formed. In a plan view of the combustion chamber (10) viewed from below in the axial direction, the coated portion (84) is formed in a range other than ±30° in a circumferential direction of the cylinder liner (6) with respect to a first straight line (SL1) extending from a center axis (CA) of the cylinder liner (6) in a direction perpendicular to an axis (CB) of a piston pin (13) which rotatably supports the piston (5).

Since the piston (5) swings in the direction perpendicular to the axis (CB) of the piston pin (13), there is a high possibility that the upper portion of the piston (5) collides with the thermal barrier coating member (7) in the predetermined range (R3, R4)(for example, ±30°) in the circumferential direction of the cylinder liner (6) with respect to the first straight line (SL1) extending in the direction perpendicular to the axis (CB) of the piston pin (13). If the thermal barrier coating layer (9) is separated from the base layer (8) due to the collision between the upper portion of the piston (5) and the thermal barrier coating layer (9) of the thermal barrier coating member (7), the vicinity of the separated portion becomes easy to separate, so that the separation of the thermal barrier coating layer (9) from the base layer (8) may progress, and the thermal barrier performance of the thermal barrier coating layer (9) may deteriorate at an early stage. According to the above configuration 9), since the coated portion (84) is not formed in the predetermined range (R3, R4 (for example, ±30°)) where the upper portion of the piston (5) is likely to collide with the thermal barrier coating member (7), it is possible to effectively prevent the collision between the thermal barrier coating layer (9) and the upper portion of the piston (5). By preventing the collision between the thermal barrier coating layer (9) and the upper portion of the piston (5), it is possible to prevent the thermal barrier coating layer (9) from separating from the base layer (8), so that it is possible to maintain the thermal barrier performance of the thermal barrier coating layer (9) for a long time.

10) In some embodiments, in the thermal barrier coating member (7) described in any one of 1) to 9), the base layer (8) includes: a coated portion (84) on which the thermal barrier coating layer (9) is formed; and an exposed portion (85) on which the thermal barrier coating layer (9) is not formed. In a plan view of the combustion chamber (10) viewed from below in the axial direction, the coated portion (84) is formed in a range other than ±15° in a circumferential direction of the cylinder liner (6) with respect to a second straight line (SL2) extending from a center axis (CA) of the cylinder liner (6) and passing through center (CP) of an intake port (16A).

If the thermal barrier coating layer (9) is disposed in the vicinity of the intake port (16A), the combustion gas (e.g., combustion air) introduced into the combustion chamber (10) through the intake port (16A) may be heated and expanded by heat stored in the thermal barrier coating layer (9) before combustion, resulting in a decrease in combustion efficiency. According to the above configuration 10), the thermal barrier coating layer (9) does not have the coated portion (84) in the vicinity of the intake port (16A), i.e., in a plan view of the combustion chamber (10) viewed from below in the axial direction, in the predetermined range (R7, R8 (e.g., a range of ±15°)) in the circumferential direction of the cylinder liner (6) with respect to the second straight line (SL2) extending from the center axis (CA) of the cylinder liner (6) and passing through the center (CP) of the intake port (16A), but has the coated portion (84) in the range (R9, R10) other than the predetermined range (R7, R8). Thus, since the coated portion (84) is not formed in the vicinity of the intake port (16A), the combustion gas introduced into the combustion chamber (10) through the intake port (16A) is prevented from being heated by heat stored in the thermal barrier coating layer (9) before combustion, suppressing a decrease in combustion efficiency.

REFERENCE SIGNS LIST

1, 1A Engine
3 Cylinder block
4 Cylinder head
5 Piston
6 Cylinder liner
7 Thermal barrier coating member
8 Base layer
9 Thermal barrier coating layer
9A First thermal barrier coating layer
9B Second thermal barrier coating layer
10 Combustion chamber
11 Combustion chamber forming portion
12 Piston ring
12A Combustion chamber-side piston ring
13 Piston pin
14 Connecting rod
15 Crankshaft
16 Intake passage
16A Intake port
17 Exhaust passage
17A Exhaust port
18 Intake valve
19 Exhaust valve
20 Precombustion chamber
21 Precombustion chamber forming portion
22 Precombustion chamber mouthpiece
23 Injection hole
24 Ignition device
25 Fuel supply device
26 Fuel supply valve
30 Space
42 Lower surface
51 Head portion
52 Skirt portion
53 Top surface
54 Piston ring groove
55 Outer peripheral surface
56 Upper end
60 Interior space
61, 65 Inner wall surface
62 Recess
63 Step wall surface
64 Step surface
66 Upper surface
81 Outside surface
82 Inside surface
83 Lower end portion
84, 84A to 84D Coated portion
85 Exposed portion
86, 86A, 86B Protrusion
87 Lower protrusion
88 Upper protrusion
91 One surface
92 Other surface
93 Lower edge
94 Upper edge
821 Upper inside surface
822, 826 Lower inside surface
823 Step surface
824, 827 Lower inclined surface
825 Inclined surface
828 Protruding surface portion
828A Upward inclined surface
828B Downward inclined surface
841 First inner surface
842 Second inner surface
843 Third inner surface
CA Center axis
CB Axis
CP Center
P1 to P3 Intersection
R1 to R10 Range
SL1 First straight line
SL2 Second straight line

The invention claimed is:

1. A thermal barrier coating member, at least one of which is mounted on an inner wall surface of a cylinder liner accommodating a piston slidably along an axial direction, the inner wall surface facing a combustion chamber of an engine, the thermal barrier coating member comprising:

a base layer configured to be detachably fitted into a recess formed in the inner wall surface of the cylinder liner; and a thermal barrier coating layer formed on an opposite side of the base layer from the inner wall surface of the cylinder liner, wherein the thermal barrier coating layer is disposed above a piston ring which is positioned at an uppermost position in the axial direction of the cylinder liner when the piston reaches top dead center, wherein the base layer includes:

a coated portion on which the thermal barrier coating layer is formed; and an exposed portion on which the thermal barrier coating layer is not formed, and wherein at least a part of the exposed portion has a protrusion which protrudes to the opposite side from the inner wall surface with respect to the thermal barrier coating layer formed on the coated portion.

2. The thermal barrier coating member according to claim 1, wherein the protrusion includes a lower protrusion formed at a lower end portion of the base layer in the axial direction, and wherein the coated portion is disposed above the lower protrusion in the axial direction.

3. The thermal barrier coating member according to claim 2, wherein the coated portion has a first inner surface extending along the axial direction.

4. The thermal barrier coating member according to claim 2, wherein the coated portion has a second inner surface inclined such that a distance from a center axis of the cylinder liner increases toward an upper side in the axial direction.

5. The thermal barrier coating member according to claim 2, wherein the protrusion further includes an upper protrusion disposed above the lower protrusion in the axial direction.

6. The thermal barrier coating member according to claim 1, wherein, in a plan view of the combustion chamber viewed from below in the axial direction, the protrusion is formed within a range of at least ±30° in a circumferential direction of the cylinder liner with respect to a first straight line extending from a center axis of the cylinder liner in a direction perpendicular to an axis of a piston pin which rotatably supports the piston.

7. The thermal barrier coating member according to claim 1, wherein at least one of an upper edge or a lower edge of the thermal barrier coating layer is tapered toward a tip side.

8. A thermal barrier coating member, at least one of which is mounted on an inner wall surface of a cylinder liner accommodating a piston slidably along an axial direction, the inner wall surface facing a combustion chamber of an engine, the thermal barrier coating member comprising:

a base layer configured to be detachably fitted into a recess formed in the inner wall surface of the cylinder liner; and a thermal barrier coating layer formed on an opposite side of the base layer from the inner wall surface of the cylinder liner, wherein the thermal barrier coating layer is disposed above a piston ring which is positioned at an uppermost position in the axial direction of the cylinder liner when the piston reaches top dead center, wherein the base layer includes:

a coated portion on which the thermal barrier coating layer is formed; and an exposed portion on which the thermal barrier coating layer is not formed, and wherein, in a plan view of the combustion chamber viewed from below in the axial direction, the coated portion is formed in a range other than ±30° in a circumferential direction of the cylinder liner with respect to a first straight line extending from a center axis of the cylinder liner in a direction perpendicular to an axis of a piston pin which rotatably supports the piston.

9. A thermal barrier coating member, at least one of which is mounted on an inner wall surface of a cylinder liner accommodating a piston slidably along an axial direction, the inner wall surface facing a combustion chamber of an engine, the thermal barrier coating member comprising:

a base layer configured to be detachably fitted into a recess formed in the inner wall surface of the cylinder liner; and a thermal barrier coating layer formed on an opposite side of the base layer from the inner wall surface of the cylinder liner, wherein the thermal barrier coating layer is disposed above a piston ring which is positioned at an uppermost position in the axial direction of the cylinder liner when the piston reaches top dead center, wherein the base layer includes:

a coated portion on which the thermal barrier coating layer is formed; and an exposed portion on which the thermal barrier coating layer is not formed, and wherein, in a plan view of the combustion chamber viewed from below in the axial direction, the coated portion is formed in a range other than ±15° in a circumferential direction of the cylinder liner with respect to a second straight line extending from a center axis of the cylinder liner and passing through center of an intake port.

* * * * *